US008016665B2

(12) United States Patent
Gururajan et al.

(10) Patent No.: US 8,016,665 B2
(45) Date of Patent: Sep. 13, 2011

(54) TABLE GAME TRACKING

(75) Inventors: Prem Gururajan, Kitchener (CA); Maulin Gandhi, Kitchener (CA); Jason Jackson, Hamilton (CA); Alex Levinshtein, Kitchener (CA)

(73) Assignee: Tangam Technologies Inc., Waterloo, Ontario (CA)

( * ) Notice: Subject to any disclaimer, the term of this patent is extended or adjusted under 35 U.S.C. 154(b) by 1545 days.

(21) Appl. No.: 11/384,427

(22) Filed: Mar. 21, 2006

(65) Prior Publication Data

US 2006/0252521 A1 Nov. 9, 2006

Related U.S. Application Data

(60) Provisional application No. 60/676,936, filed on May 3, 2005, provisional application No. 60/693,406, filed on Jun. 24, 2005, provisional application No. 60/723,481, filed on Oct. 5, 2005, provisional application No. 60/723,452, filed on Oct. 5, 2005, provisional application No. 60/736,334, filed on Nov. 15, 2005, provisional application No. 60/760,365, filed on Jan. 20, 2006.

(51) Int. Cl.
*A63F 9/24* (2006.01)

(52) U.S. Cl. ..... 463/24; 463/1; 463/29; 463/47

(58) Field of Classification Search ..... 463/1, 29, 463/24, 47

See application file for complete search history.

(56) References Cited

U.S. PATENT DOCUMENTS 4,531,187 A 7/1985 Uhland
5,941,769 A 8/1999 Order
6,460,848 B1 10/2002 Soltys et al.
6,517,435 B2 2/2003 Soltys et al.
6,517,436 B2 2/2003 Soltys et al.
6,520,857 B2 2/2003 Soltys et al.
6,527,271 B2 3/2003 Soltys et al.
6,530,836 B2 3/2003 Soltys et al.
6,530,837 B2 3/2003 Soltys et al.
6,533,276 B2 3/2003 Soltys et al.
6,533,662 B2 3/2003 Soltys et al.
6,579,180 B2 6/2003 Soltys et al.
6,579,181 B2 6/2003 Soltys et al.

(Continued)

OTHER PUBLICATIONS

Eatinger et al., The Playing Card Image Recognition Project, Accessed prior to Mar. 15, 2005, http://www.owlnet.rice.edu/~rwagner/play.html.

(Continued)

*Primary Examiner* — David L Lewis
*Assistant Examiner* — Robert Mosser
(74) *Attorney, Agent, or Firm* — Anglehart et al.

(57) ABSTRACT

The present invention relates to a system and method for identifying and tracking gaming objects and game states on a gaming table. Through the use of imaging devices and identity and positioning modules gaming objects are detected. An identity and positioning module identifies the value and position of cards on the gaming table. An intelligent position analysis and tracking (IPAT) module performs analysis of the identity and position data of cards and interprets them intelligently for the purpose of tracking game events, game states and general game progression. As a game progresses it changes states. A game tracking module processes data from the IPAT module and keeps track of game events and game states. Ambiguity resolution mechanisms such as backward tracking, forward tracking and multiple state tracking may be used in the process of game tracking. All events on the gaming table are recorded and stored on video and as data for reporting and analysis.

10 Claims, 37 Drawing Sheets

U.S. PATENT DOCUMENTS

| | | | | |
|---|---|---|---|---|
| 6,595,857 | B2 | 7/2003 | Soltys et al. | |
| 6,638,161 | B2 | 10/2003 | Soltys et al. | |
| 6,652,379 | B2 | 11/2003 | Soltys et al. | |
| 6,663,490 | B2 | 12/2003 | Soltys et al. | |
| 6,685,568 | B2 | 2/2004 | Soltys et al. | |
| 6,688,979 | B2 | 2/2004 | Soltys et al. | |
| 6,712,696 | B2 | 3/2004 | Soltys et al. | |
| 7,114,718 | B2 * | 10/2006 | Grauzer et al. | 273/149 R |
| 2003/0096643 | A1 | 5/2003 | Montgomery | |
| 2003/0125109 | A1 | 7/2003 | Green | |
| 2004/0137977 | A1 | 7/2004 | Fujimoto | |
| 2004/0207156 | A1 | 10/2004 | Soltys et al. | |
| 2005/0026680 | A1 | 2/2005 | Gururajan | |
| 2005/0054408 | A1 | 3/2005 | Steil et al. | |
| 2005/0146094 | A1 | 7/2005 | Soltys et al. | |
| 2005/0272501 | A1 | 12/2005 | Tran et al. | |

OTHER PUBLICATIONS

Wesley Cooper, Blackjack Tracking System, Apr. 2004, Trinity College, Dublin, Ireland https://www.cs.tcd.ie/Kenneth.Dawson-Howe/Projects/FYP2004_WesleyCooper.pdf.

Moore et al., Object Spaces: Recognizing Multi-tasked Activities from Video Using Stochastic Context Free Grammar, Access prior to Mar. 15, 2005, http://www-static.cc.gatech.edu/gvu/perception//projects/objectspaces/.

* cited by examiner

TABLE GAME TRACKING

RELATED APPLICATIONS

This application claims priority from U.S. Provisional Patent application numbers, 60/676,936, filed May 3, 2005; 60/693,406, filed Jun. 24, 2005; 60/723,481, filed Oct. 5, 2005; 60/723,452, filed Oct. 5, 2005; 60/736,334, filed Nov. 15, 2005; and 60/760,365, filed Jan. 20, 2006, all of which are hereby incorporated herein by reference.

BACKGROUND

In the gaming industry, there is a need for automation of tracking of activities happening at table games. Casino chips, playing cards, card hands, wagers, payouts, chip tray float, currency transactions, game outcomes and players are examples of items and activities that are tracked and monitored at casino table games. Amongst other applications, automated tracking would improve player tracking, game security, operational efficiency monitoring, and can enable development of new table games involving concepts such as bonusing, jackpots, progressive jackpots and side betting.

There are several issues and challenges with overhead video camera based game monitoring. One challenge is that performing repetitive optical recognition on consecutive images in a video stream can be processing intensive. Another challenge is that gaming objects might occasionally be partially or entirely occluded from an overhead camera view. A playing card can be occluded because of the dealer's clothing, hands or other gaming objects. Yet another issue is that cards and card hands that are moved on the table can result in blurred images. Sometimes, due to space constraints a dealer may place playing card hands such that two or more playing card hands have some overlap even though ideally there should not be any overlap between distinct playing card hands. There could be other objects on the table, such as patterns on dealer clothing, that may appear somewhat similar to a playing card shape and consequently result in erroneous playing card detection ("false positives"). The disclosed invention seeks to alleviate some of these problems and challenges with respect to overhead video camera based game monitoring.

It is unreasonable to expect any gaming object positioning and identification system to be perfect. There are often scenarios where a game tracking method must analyze ambiguous gaming object data in determining the game state and game progress. For instance, an overhead video camera based recognition system can produce ambiguous or incomplete data caused by playing card occlusion, movement, false positives, dealer mistakes and overlapping of card hands. Other systems involving RFID embedded playing cards could produce similar ambiguity relating to position, movement, distinction of separate card hands, dealer mistakes false positives etc. The disclosed invention seeks to alleviate some of the challenges of ambiguous data by providing methods to improve robustness of game tracking.

SUMMARY

A first embodiment is directed to a method of tracking the progress of a game on a gaming table comprising:

recording data frames and game states as data while said game is in progress;

establishing a first state of said game from said data;

identifying an occurrence of a game event that follows said first state;

evaluating whether said game event and a set of rules of said game provide sufficient information to accurately create a second state;

determining that further information is required to accurately create said second state according to the results of said evaluating;

obtaining said further information from said data; and creating a second state according to said game event, said set of rules and said further information.

Another embodiment is directed to a method of tracking the progress of a game on a gaming table comprising:

recording data relating to said game while said game is in progress;

establishing a plurality of potential game states of said game;

identifying an occurrence of a game event that follows said plurality of potential game states;

applying said game event to at least two of said plurality of potential game states to establish at least one new potential game state;

adding said at least one new potential game state to said plurality of potential game states to establish an updated plurality of potential states;

evaluating a likelihood of each potential game state, and;

identifying at least one likely potential game state of said updated plurality based on said evaluating.

Yet another embodiment is directed to a system of tracking the progress of a game on a gaming table comprising:

means for recording data frames and game states as data while said game is in progress;

means for establishing a first state of said game from said data;

means for identifying an occurrence of a game event that follows said first state;

means for evaluating whether said game event and a set of rules of said game provide sufficient information to accurately create a second state;

means for determining that further information is required to accurately create said second state according to the results of said evaluating;

means for obtaining said further information from said data; and means for creating a second state according to said game event, said set of rules and said further information.

Still yet another embodiment is directed to a system for tracking the progress of a game on a gaming table comprising:

means for recording data relating to said game while said game is in progress;

means for establishing a plurality of potential game states of said game;

means for identifying an occurrence of a game event that follows said plurality of potential game states;

means for applying said game event to at least two of said plurality of potential game states to establish at least one new potential game state;

means for adding said at least one new potential game state to said plurality of potential game states to establish an updated plurality of potential states;

means for evaluating a likelihood of each potential game state, and;

means for identifying at least one likely potential game state of said updated plurality based on said evaluating.

BRIEF DESCRIPTION OF THE DRAWINGS

For a better understanding of embodiments of the present invention, and to show more clearly how it may be carried into effect, reference will now be made, by way of example, to the accompanying drawings which aid in understanding and in which.

DETAILED DESCRIPTION OF EMBODIMENTS

In the following description of exemplary embodiments we will use the card game of blackjack as an example to illustrate how the embodiments may be utilized.

Figure 1:
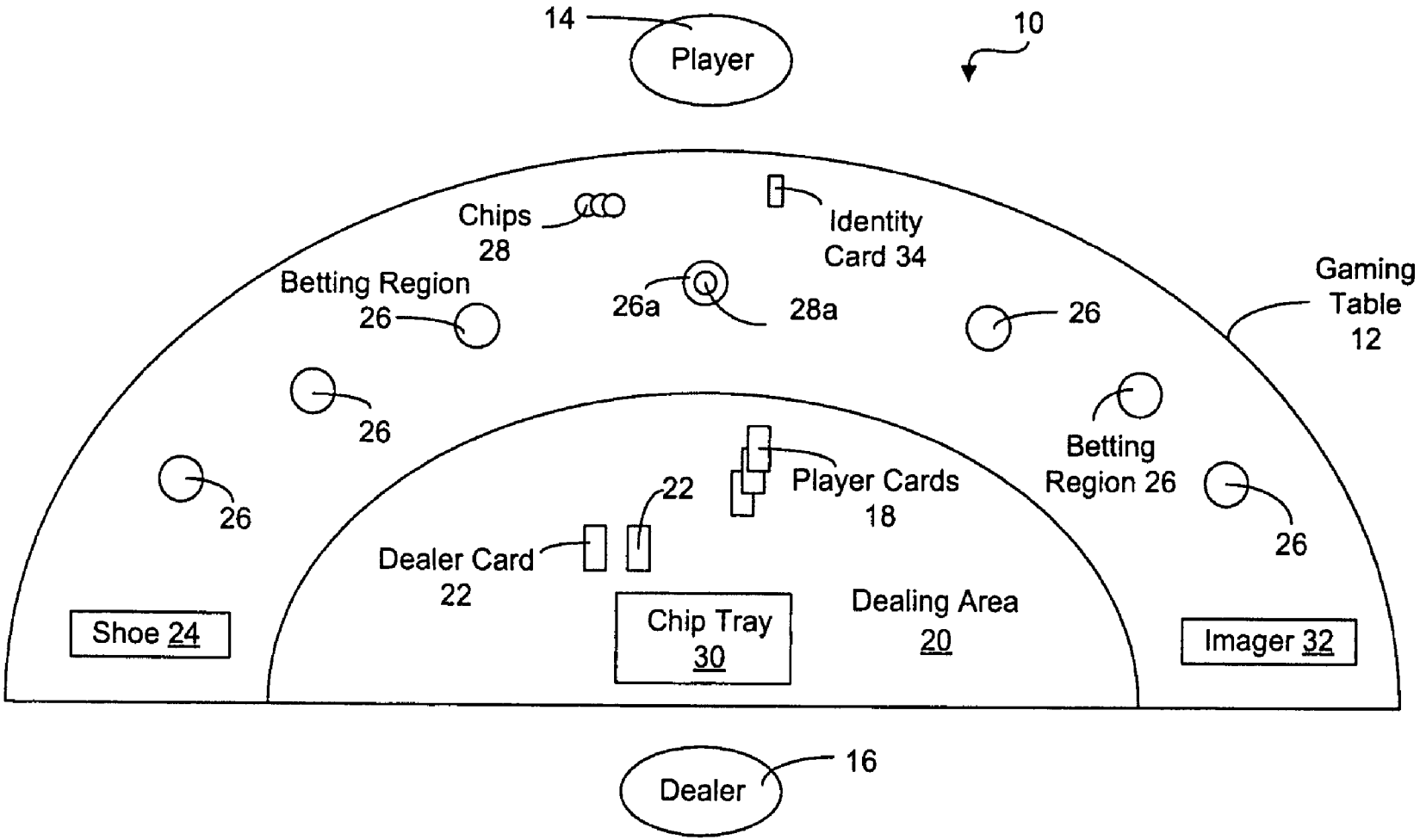
FIG. 1 is an overhead view of a card game.

Referring now to FIG. 1 an overhead view of a card game is shown generally as 10. More specifically, FIG. 1 is an example of a blackjack game in progress. A gaming table is shown as feature 12. Feature 14 is a single player and feature 16 is the dealer. Player 14 has three cards 18 dealt by dealer 16 within dealing area 20. The dealer's cards are shown as feature 22. In this example dealer 16 utilizes a card shoe 24 to deal cards 18 and 22 and places them in dealing area 20. Within gaming table 12 there are a plurality of betting regions 26 in which a player 14 may place a bet. A bet is placed through the use of chips 28. Chips 28 are wagering chips used in a game, examples of which are plaques, jetons, wheelchecks, Radio Frequency Identification Device (RFID) embedded wagering chips and optically encoded wagering chips.

An example of a bet being placed by player 14 is shown as chips 28*a* within betting region 26*a*. Dealer 16 utilizes chip tray 30 to receive and provide chips 28. Feature 32 is an imaging system, which is utilized by the present invention to provide overhead imaging and optional lateral imaging of game 10. An optional feature is a player identity card 34, which may be utilized by the present invention to identify a player 14.

At the beginning of every game players 14 that wish to play place their wager, usually in the form of gaming chips 28, in a betting region 26 (also known as betting circle or wagering area). Chips 28 can be added to a betting region 26 during the course of the game as per the rules of the game being played. The dealer 16 then initiates the game by dealing the playing cards 18, 22. Playing cards can be dealt either from the dealer's hand, or from a card dispensing mechanism such as a shoe 24. The shoe 24 can take different embodiments including non-electromechanical types and electromechanical types. The shoe 24 can be coupled to an apparatus (not shown) to read, scan or image cards being dealt from the shoe 24. The dealer 16 can deal the playing cards 18, 22 into dealing area 20. The dealing area 20 may have a different shape or a different size than shown in FIG. 1. The dealing area 20, under normal circumstances, is clear of foreign objects and usually only contains playing cards 18, 22, the dealer's body parts and predetermined gaming objects such as chips, currency, player identity card 34 and dice. A player identity card 34 is an identity card that a player 14 may possess, which is used by the player to provide identity data and assist in obtaining complimentary ("comps") points from a casino. A player identity card 34 may be used to collect comp points, which in turn may be redeemed later on for comps.

During the progression of the game, playing cards 18, 22 may appear, move, or be removed from the dealing area 20 by the dealer 16. The dealing area 20 may have specific regions outlined on the table 12 where the cards 18, 22 are to be dealt in a certain physical organization otherwise known as card sets or "card hands", including overlapping and non-overlapping organizations.

For the purpose of this disclosure, chips, cards, card hands, currency bills, player identity cards and dice are collectively referred to as gaming objects. In addition the term "gaming region" is meant to refer to any section of gaming table 12 including the entire gaming table 12.

Figure 2:
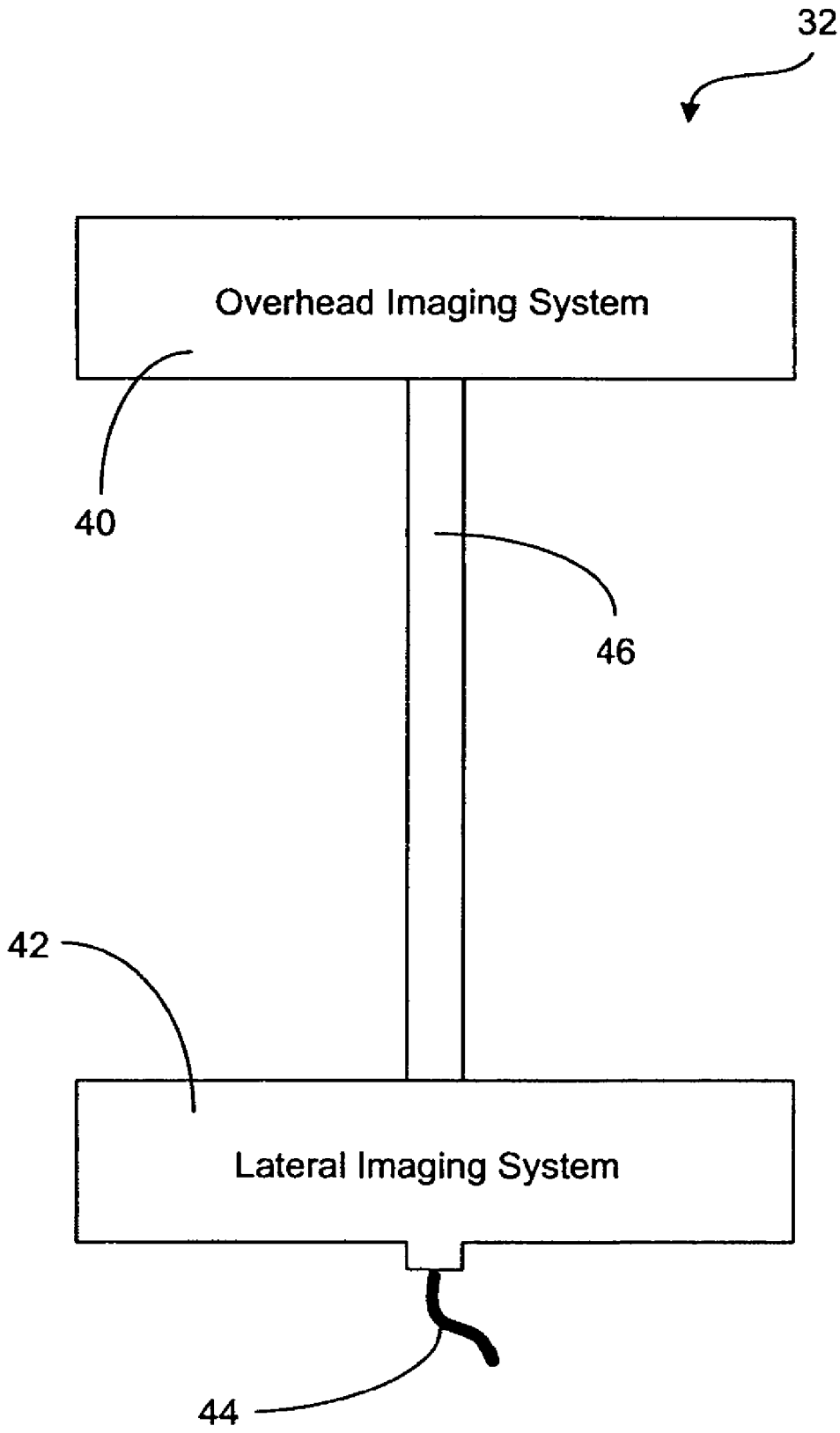
FIG. 2 is a side plan view of an imaging system.

Referring now to FIG. 2, a side plan view of an imaging system is shown. This is imaging system 32 of FIG. 1. Imaging system 32 comprises overhead imaging system 40 and optional lateral imaging system 42. Imaging system 32 can be located on or beside the gaming table 12 to image a gaming region from a top view and/or from a lateral view. Overhead imaging system 40 can periodically image a gaming region from a planar overhead perspective. The overhead imaging system 40 can be coupled to the ceiling or to a wall or any location that would allow an approximate top view of the table 12. The optional lateral imaging system 42 can image a gaming region from a lateral perspective. Imaging systems 40 and 42 are connected to a power supply and a processor (not shown) via wiring 44 which runs through tower 46.

The imaging system 32 utilizes periodic imaging to capturing a video stream at a specific number of frames over a specific period of time, such as for example, thirty frames per second. Periodic imaging can also be used by an imaging system 32 when triggered via software or hardware means to capture an image upon the occurrence of a specific event. An example of a specific event would be if a stack of chips were placed in a betting region 26. An optical chip stack or chip detection method utilizing overhead imaging system 40 can detect this event and can send a trigger to lateral imaging system 42 to capture an image of the betting region 26. In an alternative embodiment overhead imaging system 40 can trigger an RFID reader to identify the chips. Should there be a discrepancy between the two means of identifying chips the discrepancy will be flagged.

Figure 3:
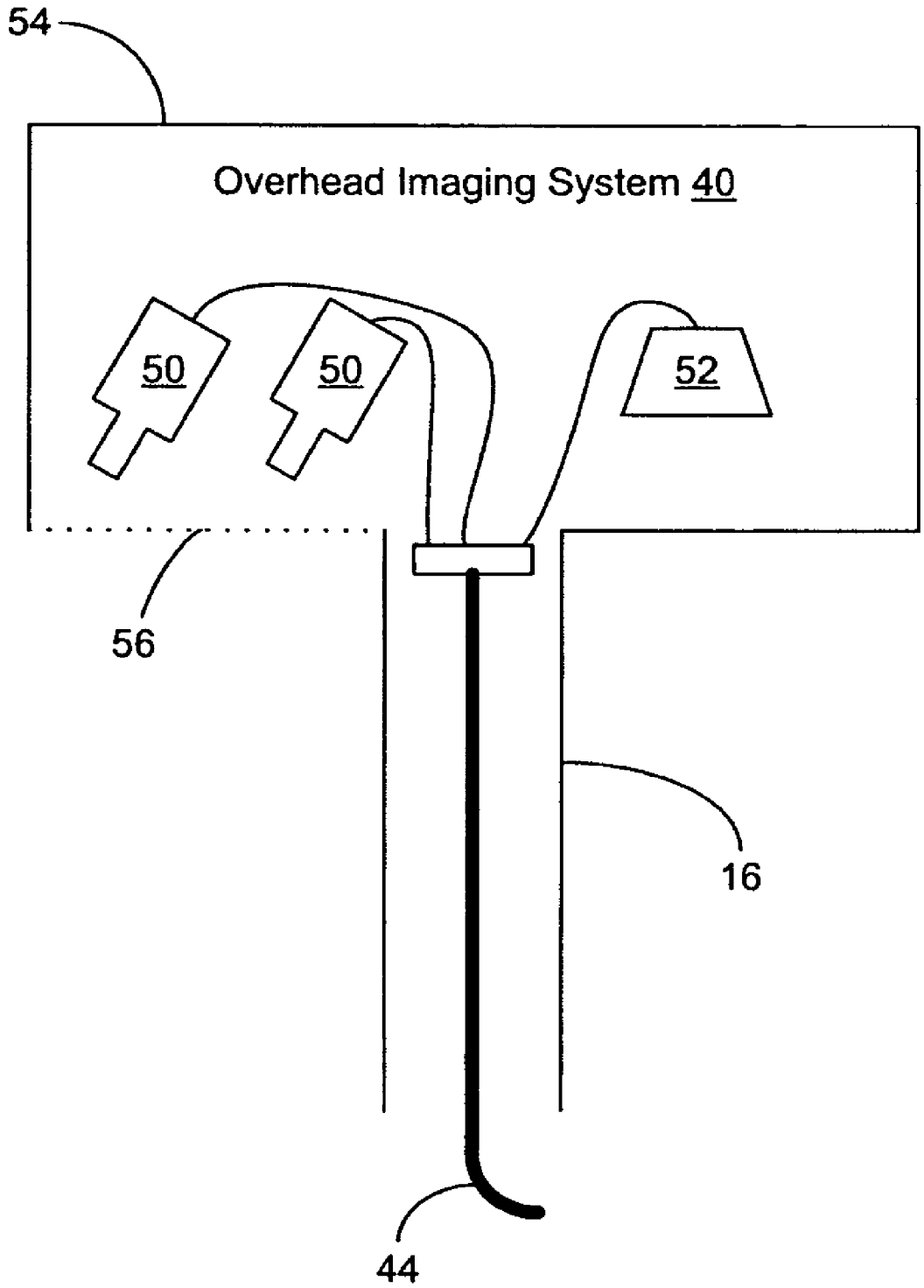
FIG. 3 is a side plan view of an overhead imaging system.

Referring now to FIG. 3, a side plan view of an overhead imaging system is shown. Overhead imaging system 40 comprises one or more imaging devices 50 and optionally one or more lighting sources (if required) 52 which are each connected to wiring 44. Each imaging device 50 can periodically produce images of a gaming region. Charged Coupling Device (CCD) sensors, Complementary Metal Oxide Semiconductor (CMOS) sensors, line scan imagers, area-scan imagers and progressive scan imagers are examples of imaging devices 50. Imaging devices 50 may be selective to any frequency of light in the electro-magnetic spectrum, including ultra violet, infra red and wavelength selective. Imaging devices 50 may be color or grayscale. Lighting sources 52 may be utilized to improve lighting conditions for imaging. Incandescent, fluorescent, halogen, infra red and ultra violet light sources are examples of lighting sources 52.

An optional case 54 encloses overhead imaging system 40 and if so provided, includes a transparent portion 56, as shown by the dotted line, so that imaging devices 50 may view a gaming region.

Figure 4:
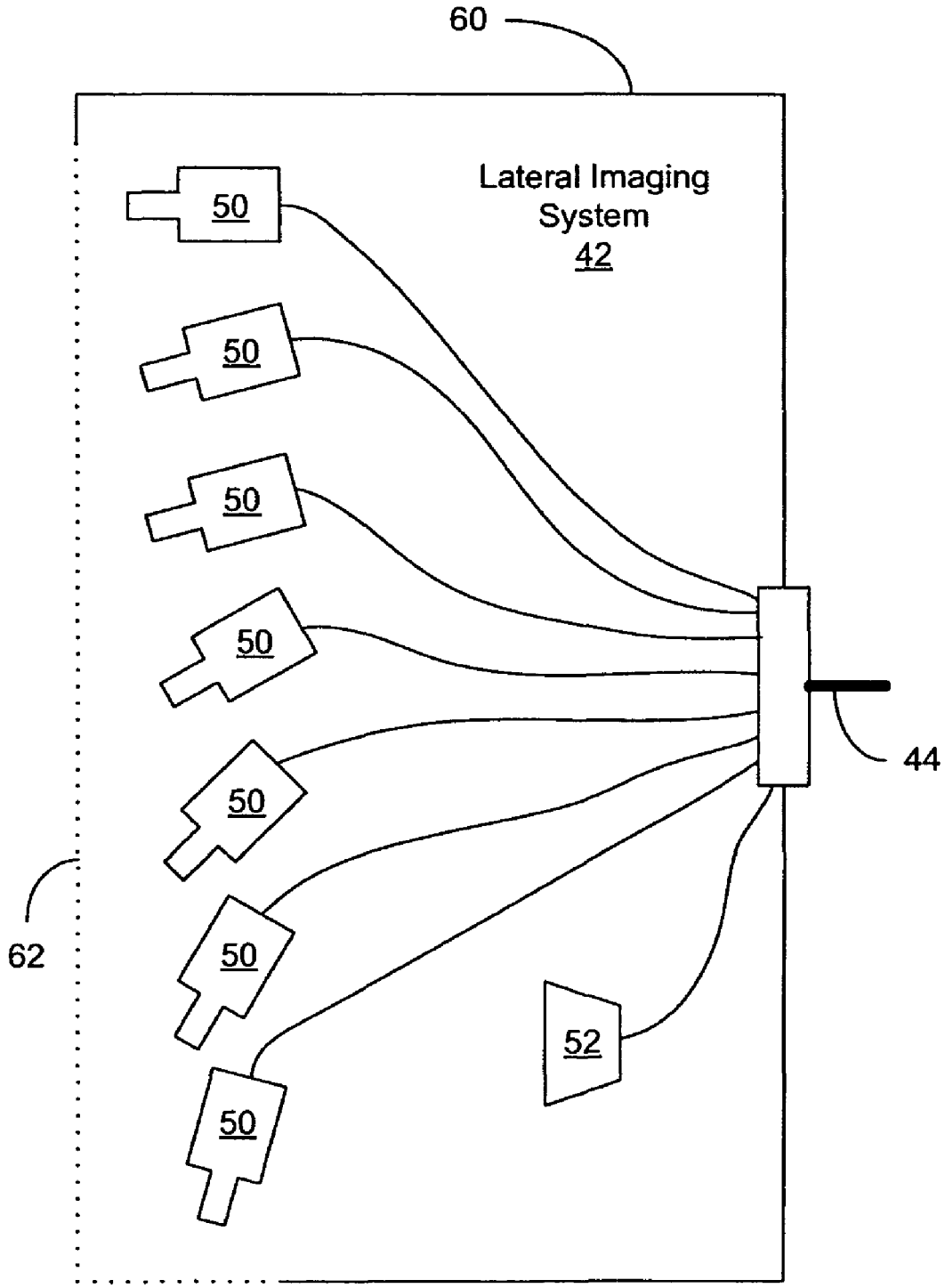
FIG. 4 is a top plan view of a lateral imaging system.

Referring now to FIG. 4, a top plan view of a lateral imaging system is shown. Lateral imaging system 42 comprises one or more imaging devices 50 and optional lighting sources 52 as described with reference to FIG. 3.

An optional case 60 encloses lateral imaging system 42 and if so provided includes a transparent portion 62, as shown by the dotted line, so that imaging devices 50 may view a gaming region.

The examples of overhead imaging system 40 and lateral imaging system 42 are not meant by the inventors to restrict the configuration of the devices to the examples shown. Any number of imaging devices 50 may be utilized and if a case is used to house the imaging devices 50, the transparent portions 56 and 62 may be configured to scan the desired gaming regions.

Figure 5:
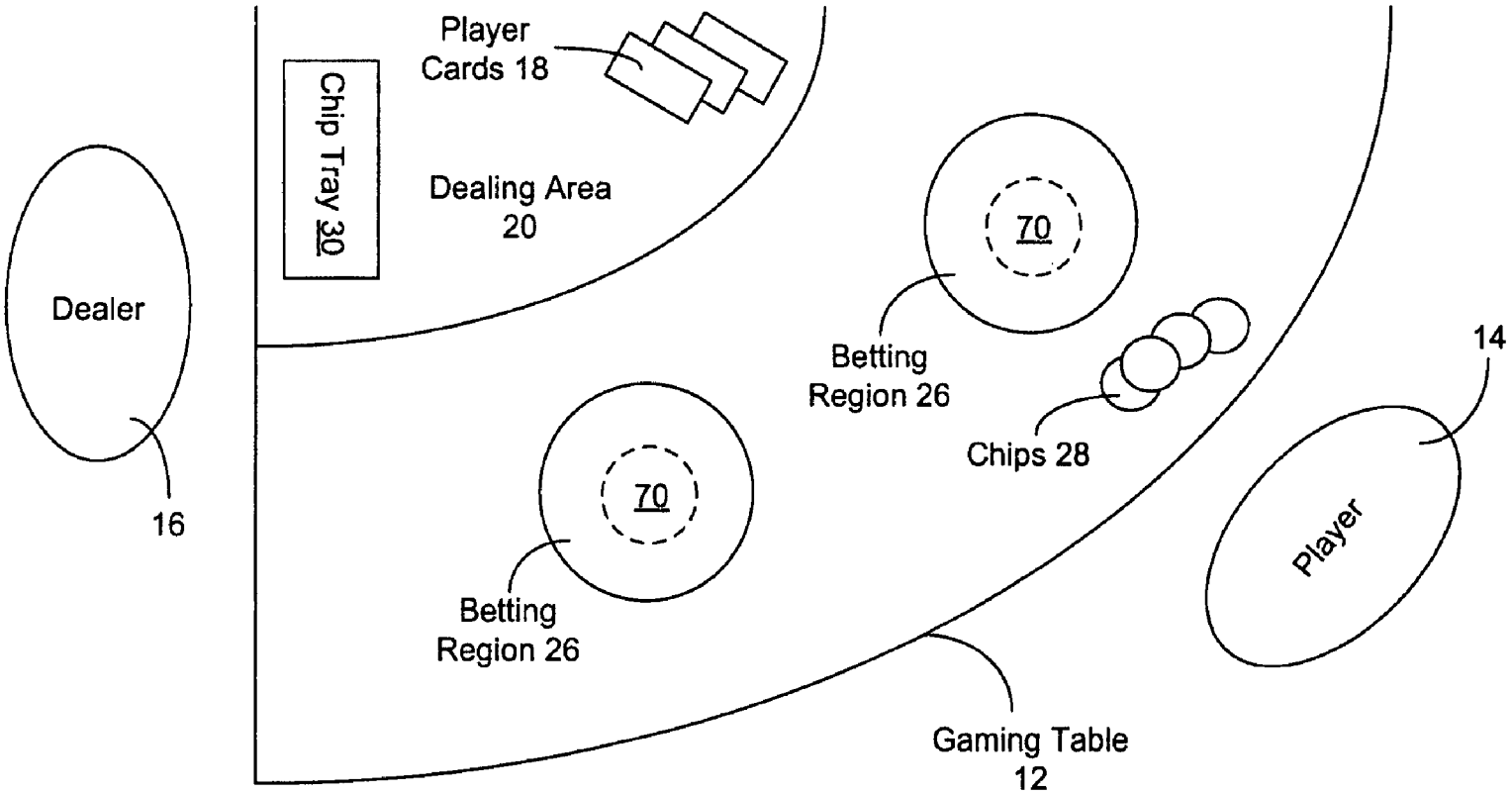
FIG. 5 is an overhead view of a gaming table containing RFID detectors.

In addition to the imaging systems described above, alternate embodiments may also make use of RFID detectors for gambling chips containing an RFID. FIG. 5 is an overhead view of a gaming table containing RFID detectors 70. When one or more chips 28 containing an RFID are placed on an RFID detector 70 situated below a betting region 26 the values of the chips 28 can be detected by the RFID detector 70. The same technology may be utilized to detect the values of RFID chips within the chip tray 30.

Figure 6:
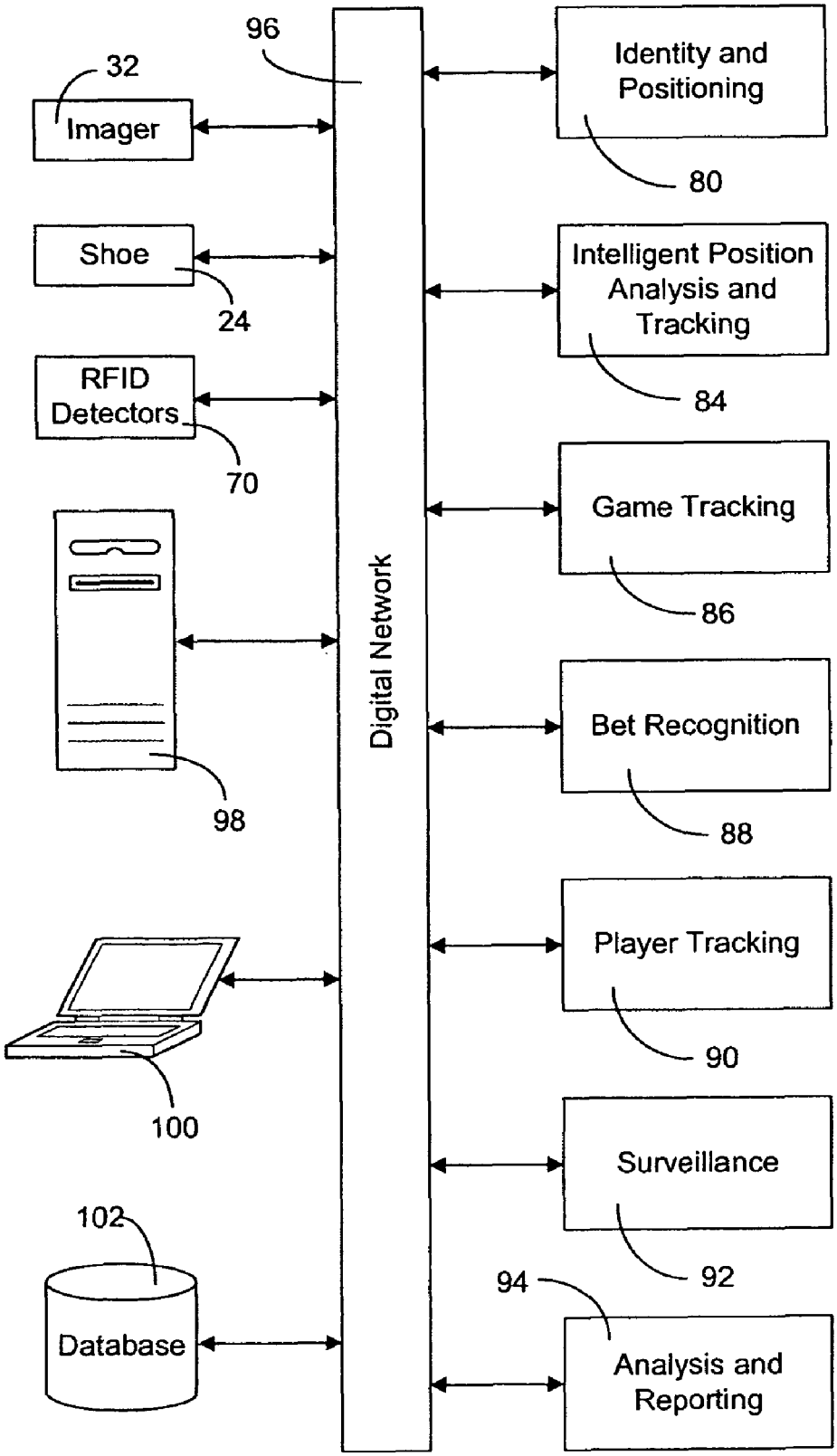
FIG. 6 is a block diagram of the components of an exemplary embodiment of a system for table game tracking.

Referring now to FIG. 6 a block diagram of the components of an exemplary embodiment is shown. Identity and Positioning module (IP module) 80 identifies the value and position of cards on the gaming table 12. Intelligent Position Analysis and Tracking module (IPAT module) 84 performs analysis of the identity and position data of cards and interprets them intelligently for the purpose of tracking game events, game states and general game progression. The Game Tracking module (GT module) 86 processes data from the IPAT module 84 and keeps track of game events and game status. The GT module 86 can optionally obtain input from Bet Recognition module 88. Bet Recognition module 88 identifies the value of wagers placed at the game. Player Tracking module 90 keeps track of patrons and players that are participating at the games. Surveillance module 92 records video data from imaging system 32 and links game event data to recorded video. Surveillance module 92 provides efficient search and replay capability by way of linking game event time stamps to the recorded video. Analysis and Reporting module 94 analyzes the gathered data in order to generate reports on players, tables and casino personnel. Example reports include reports statistics on game related activities such as profitability, employee efficiency and player playing patterns. Events occurring during the course of a game can be analyzed and appropriate actions can be taken such as player profiling, procedure violation alerts or fraud alerts.

Modules 80 to 94 communicate with one another through a network 96. A 100 Mbps Ethernet Local Area Network or Wireless Network can be used as a digital network. The digital network is not limited to the specified implementations, and can be of any other type, including local area network (LAN), Wide Area Network (WAN), wired or wireless Internet, or the World Wide Web, and can take the form of a proprietary extranet.

Controller 98 such as a processor or multiple processors can be employed to execute modules 80 to 94 and to coordinate their interaction amongst themselves, with the imaging system 32 and with input/output devices 100, optional shoe 24 and optional RFID detectors 70. Further, controller 98 utilizes data stored in database 102 for providing operating parameters to any of the modules 80 to 94. Modules 80 to 94 may write data to database 102 or collect stored data from database 102. Input/Output devices 100 such as a laptop computer, may be used to input operational parameters into database 102. Examples of operational parameters are the position coordinates of the betting regions 26 on the gaming table 12, position coordinates of the dealer chip tray 30, game type and game rules.

Figure 7:
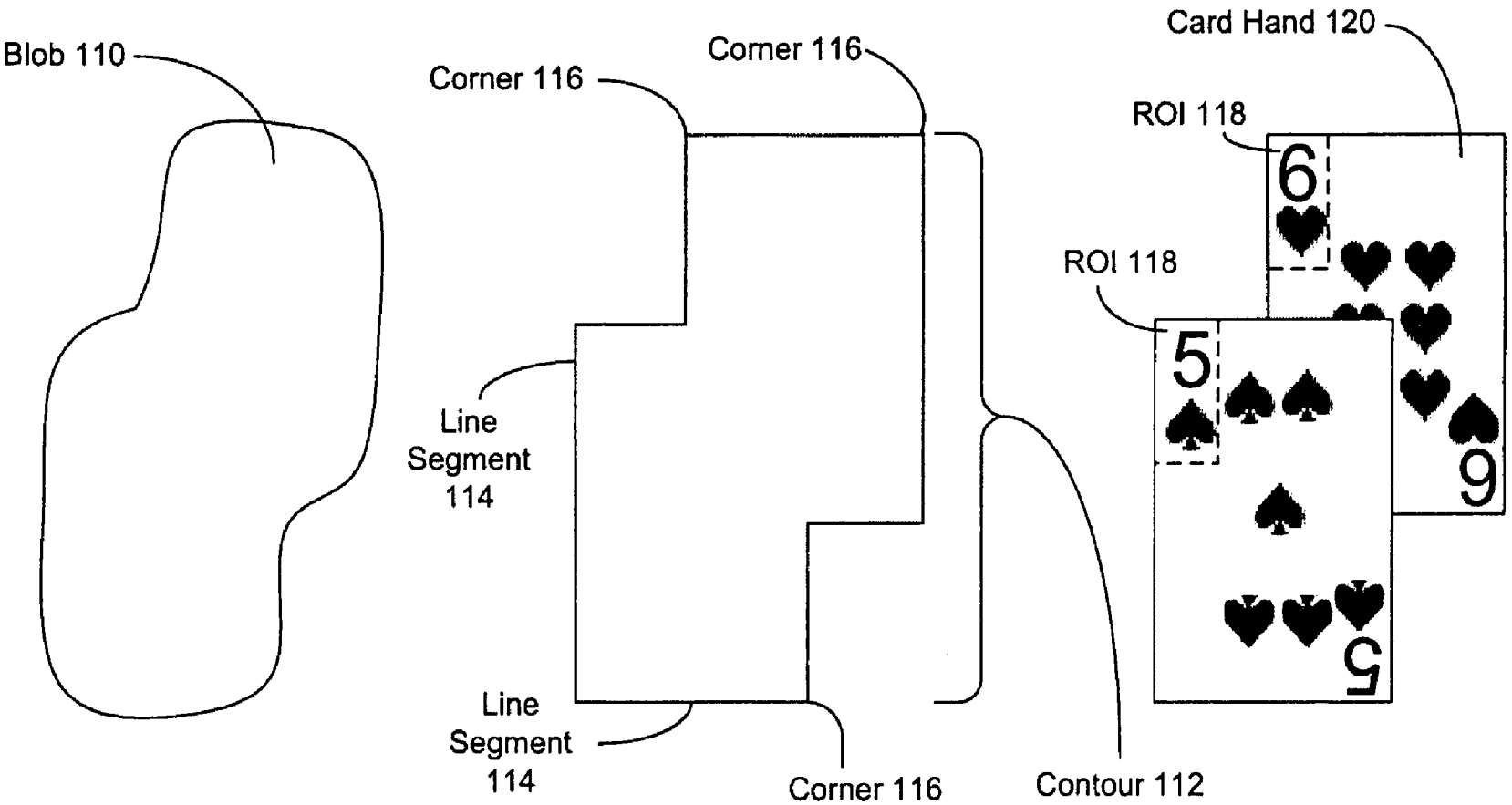
FIG. 7 is a plan view of card hand representations.

Before describing how the present invention may be implemented we first provide some preliminary definitions. Referring now to FIG. 7 a plan view of card representations is shown. A card or card hand is first identified by an image from the imaging system 32 as a blob 110. A blob may be any object in the image of a gaming area but for the purposes of this introduction we will refer to blobs 110 that are cards and card hands. The outer boundary of blob 110 is then traced to determine a contour 112 which is a sequence of boundary points forming the outer boundary of a card or a card hand. In determining a contour, digital imaging thresholding is used to establish thresholds of grey. In the case of a card or card hand, the blob 110 would be white and bright on a table. From the blob 110 a path is traced around its boundary until the contour 112 is established. A contour 112 is then examined for regions of interest (ROI) 118, which identify a specific card. Although in FIG. 7 ROI 118 has been shown to be the rank and suit of a card an alternative ROI could be used to identify the pip pattern in the centre of a card. From the information obtained from ROIs 118 it is possible to identify cards in a card hand 120.

IP module 80 may be implemented in a number of different ways. In a first embodiment, overhead imaging system 32 (see FIG. 2) located above the surface of the gaming table provides overhead images. An overhead image need not be at precisely ninety degrees above the gaming table 12. In one embodiment it has been found that seventy degrees works well to generate an overhead view. An overhead view enables the use of two dimensional Cartesian coordinates of a gaming region. One or more image processing algorithms, such as Optical Character Recognition (OCR) algorithms, process these overhead images of a gaming region to determine the identity and position of playing cards on the gaming table 12.

Figure 8:
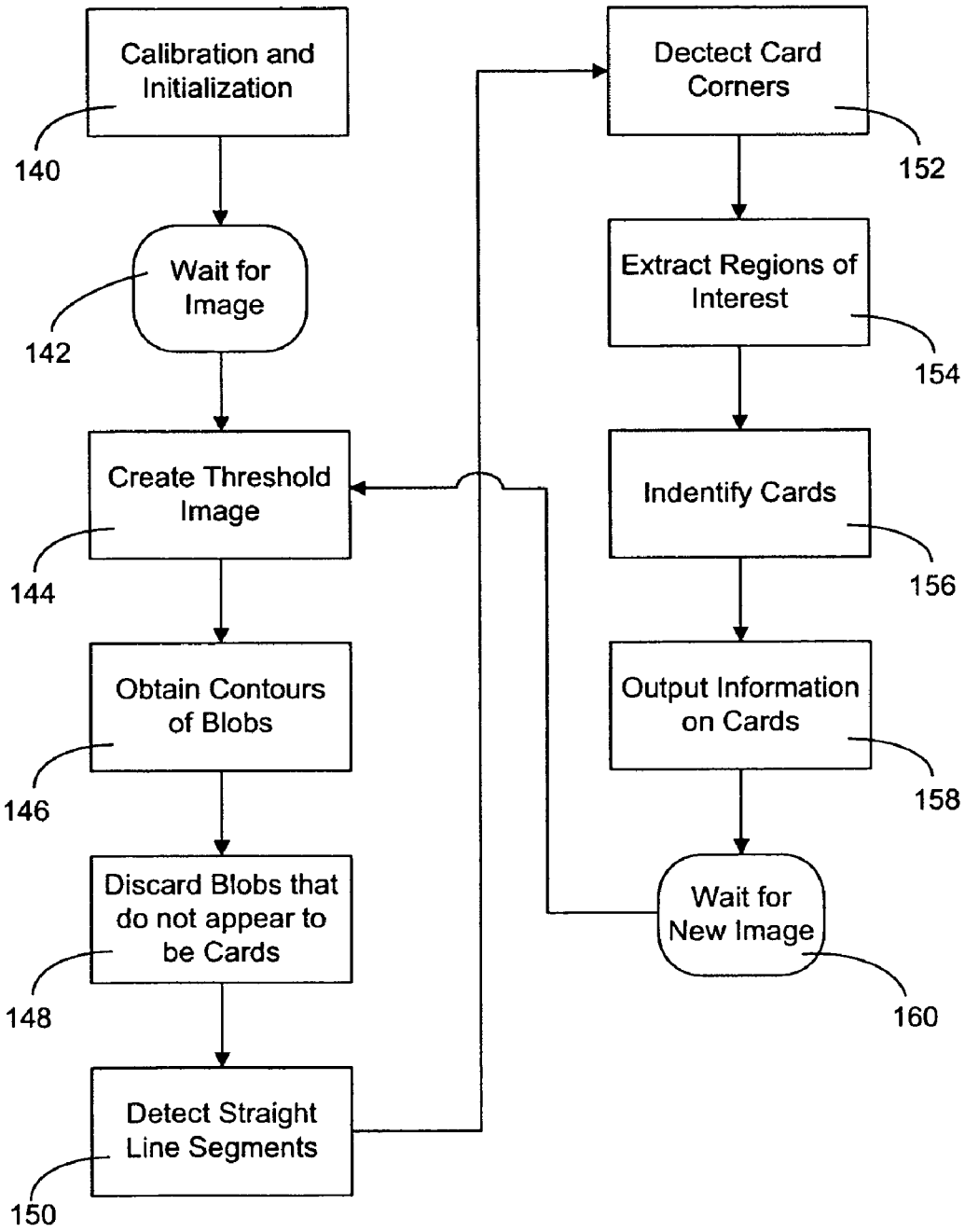
FIG. 8 is a flowchart of a first embodiment of an IP module.

Referring now to FIG. 8 a flowchart of an embodiment of an IP module 80 is shown. Beginning at step 140 initialization and calibration of global variables occurs. Examples of calibration are manual or automated setting of camera properties for an imager 32 such as shutter value, gain levels and threshold levels. In the case of thresholds, a different threshold may be stored for each pixel in the image or different thresholds may be stored for different regions of the image. Alternatively, the threshold values may be dynamically calculated from each image. Dynamic determination of a threshold would calculate the threshold level to be used for filtering out playing cards from a darker table background.

Moving to step 142 the process waits to receive an overhead image of a gaming region from overhead imaging system 40. At step 144 a thresholding algorithm is applied to the overhead image in order to differentiate playing cards from the background to create a threshold image. A background subtraction algorithm may be combined with the thresholding algorithm for improved performance. Contrast information of the playing card against the background of the gaming table 12 can be utilized to determine static or adaptive threshold parameters. Static thresholds are fixed while dynamic thresholds may vary based upon input such as the lighting on a table. The threshold operation can be performed on a gray level image or on a color image. Step 144 requires that the surface of game table 12 be visually contrasted against the card. For instance, if the surface of game table 12 is predominantly white, then a threshold may not be effective for obtaining the outlines of playing cards. The output of the thresholded image will ideally show the playing cards as independent blobs 110. This may not always be the case due to issues of motion or occlusion. Other bright objects such as a dealer's hand may also be visible as blobs 110 in the thresholded image. Filtering operations such as erosion, dilation and smoothing may optionally be performed on the thresholded image in order to eliminate noise or to smooth the boundaries of a blob 110.

In the next step 146, the contour 112 corresponding to each blob 110 is detected. A contour 112 can be a sequence of boundary points of the blob 110 that more or less define the shape of the blob 110. The contour 112 of a blob 110 can be extracted by traversing along the boundary points of the blob 110 using a boundary following algorithm. Alternatively, a connected components algorithm may also be utilized to obtain the contour 112.

Once the contours 112 have been obtained processing moves to step 148 where shape analysis is performed in order to identify contours that are likely not cards or card hands and eliminate these from further analysis. By examining the area of a contour 112 and the external boundaries, a match may be made to the known size and/or dimensions of cards. If a contour 112 does not match the expected dimensions of a card or card hand it can be discarded.

Moving next to step 150, line segments 114 forming the card and card hand boundaries are extracted. One way to extract line segments is to traverse along the boundary points of the contour 112 and test the traversed points with a line fitting algorithm. Another potential line detection algorithm that may be utilized is a Hough Transform. At the end of step 150, line segments 114 forming the card or card hand boundaries are obtained. It is to be noted that, in alternate embodiments, straight line segments 114 of the card and card hand boundaries may be obtained in other ways. For instance, straight line segments 114 can be obtained directly from an edge detected image. For example, an edge detector such as the Laplace edge detector can be applied to the source image to obtain an edge map of the image from which straight line segments 114 can be detected. These algorithms are non-limiting examples of methods to extract positioning features, and one skilled in the art might use alternate methods to extract these card and card hand positioning features.

Moving to step 152, one or more corners 116 of cards can be obtained from the detected straight line segments 114. Card corners 116 may be detected directly from the original image or thresholded image by applying a corner detector algorithm such as for example, using a template matching method using templates of corner points. Alternatively, the corner 116 may be detected by traversing points along contour 112 and fitting the points to a corner shape. Corner points 116, and line segments 114 are then utilized to create a position profile for cards and card hands, i.e. where they reside in the gaming region.

Moving to step 154, card corners 116 are utilized to obtain a Region of Interest (ROI) 118 encompassing a card identifying symbol, such as the number of the card, and the suit. A card identifying symbol can also include features located in the card such as the arrangement of pips on the card, or can be some other machine readable code.

At step 156, a recognition method may be applied to identify the value of the card. In one embodiment, the ROI 118 is rotated upright and a machine learning algorithm can be applied to recognize the symbol. Prior to recognition, the ROI 118 may be pre-processed by thresholding the image in the ROI 118 and/or narrowing the ROI 118 to encompass the card identifying symbols. A Feed-forward Neural Network is one example of a machine learning algorithm that may be used. Training of the machine learning model may happen in a supervised or unsupervised manner. In an alternate embodiment, a method that does not rely on machine learning, such as template matching, may be utilized. In yet another embodiment, the pattern of pips on the cards may be utilized to recognize the cards, provide a sufficient portion of the pattern is visible in a card hand. A combination of recognition algorithms may be used to improve accuracy of recognition.

Once the identity and position profile of each visible card in the gaming region has been obtained, the data can be output to other modules at step 158. Examples of data output at step 158 may include the number of card hands, the Cartesian coordinates of each corner of a card in a hand (or other positional information such as line segments), and the identity of the card as a rank and/or suit.

At step 160 the process waits for a new image and when received processing returns to step 144.

Figure 9:
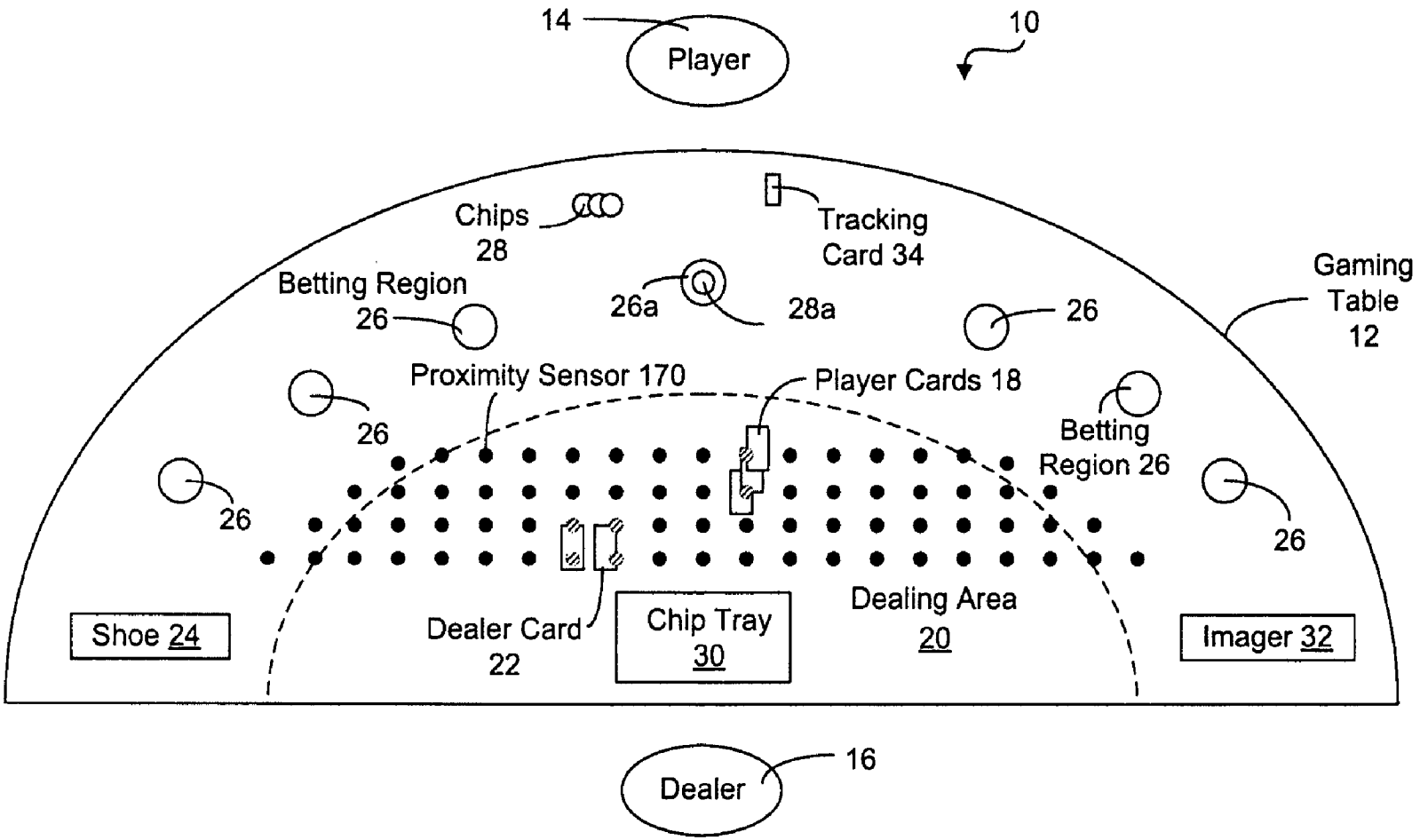
FIG. 9 is an overhead view of a gaming table with proximity detection sensors.
Figure 10:
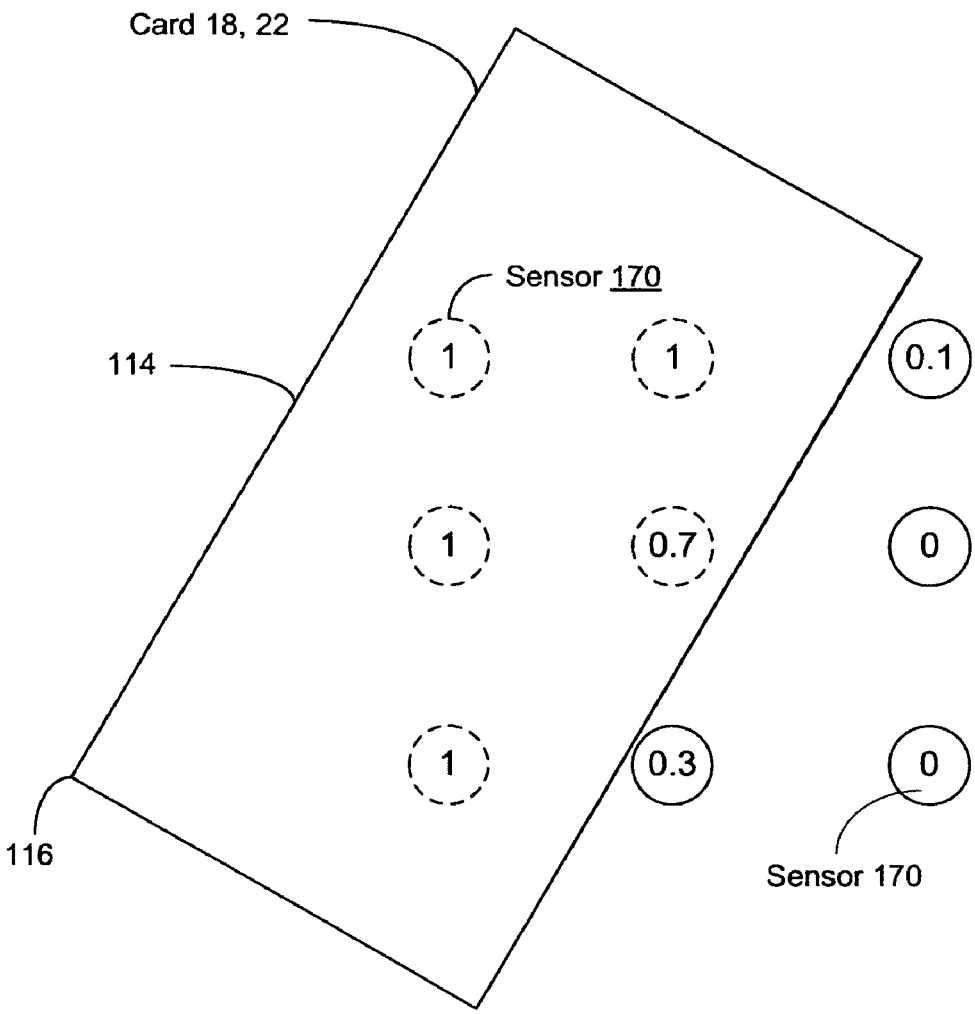
FIG. 10 is a plan view of a card position relative to proximity detection sensors.

Referring now to FIG. 9 an overhead view of gaming table with proximity detection sensors is shown. In an alternative embodiment IP module 80 may utilize proximity detection sensors 170. Card shoe 24 is a card shoe reader, which dispenses playing cards and generates signals indicative of card identity. An example of a card shoe reader 24 may include those disclosed in U.S. Pat. No. 5,374,061 to Albrecht, 5,941,769 to Order, 6,039,650 to Hill, or 6,126,166 to Lorson. Commercial card shoe readers such as for example the MP21 card reader unit sold by Bally Gaming or the Intelligent Shoe sold by Shuffle Master Inc. may be utilized. In an alternate embodiment of the card shoe reader, a card deck reader such as the readers commercially sold by Bally Gaming and Shuffle Master can be utilized to determine the identity of cards prior to their introduction into the game. Such a card deck reader would pre-determine a sequence of cards to be dealt into the game. An array of proximity detection sensors 170 can be positioned under the gaming table 12 parallel to the table surface, such that periodic sampling of the proximity detection sensors 170 produces a sequence of frames, where each frame contains the readings from the proximity detection sensors. Examples of proximity detection sensors 170 include optical sensors, infra red position detectors, photodiodes, capacitance position detectors and ultrasound position detectors. Proximity detection sensors 170 can detect the presence or absence of playing cards (or other gaming objects) on the surface of gaming table 12. Output from the array of proximity detection sensors can be analog or digital and can be further processed in order to obtain data that represents objects on the table surface as blobs and thus replace step 142 of FIG. 8. In this embodiment a shoe 24 would provide information on the card dealt and sensors 170 would provide positioning data. The density of the sensor array (resolution) will determine what types of object positioning features may be obtained. To assist in obtaining positioning features further processing may be performed such as shown in FIG. 10 which is a plan view of a card position relative to proximity detection sensors 170. Sensors 170 provide signal strength information, where the value one represents an object detected and the value zero represents no object detected. Straight lines may be fitted to the readings of sensors 170 using a line fitting method. In this manner proximity detection sensors 170 may be utilized to determine position features such as line segments 114 or corners 116.

In this embodiment, identity data generated from the card shoe reader 24 and positioning data generated from proximity detection sensors 170 may be grouped and output to other modules. Associating positional data to cards may be performed by the IPAT module 84.

In another alternate embodiment of the IP module 80, card reading may have an RFID based implementation. For example, RFID chips embedded inside playing cards may be wirelessly interrogated by RFID antennae or scanners in order to determine the identity of the cards. Multiple antennae may be used to wirelessly interrogate and triangulate the position of the RFID chips embedded inside the cards. Card positioning data may be obtained either by wireless interrogation and triangulation, a matrix of RFID sensors, or via an array of proximity sensors as explained herein.

We shall now describe the function of the Intelligent Position Analysis and Tracking module (IPAT module) 84 (see FIG. 6). The IPAT module 84 performs analysis of the identity and position data of cards/card hands and interprets them "intelligently" for the purpose of tracking game events, game states and general game progression. The IPAT module may perform one or more of the following tasks:

a) Object modeling;
b) Object motion tracking;
c) Points in contour test;
d) Detect occlusion of cards;
e) Set status flags for card positional features; and
f) Separate overlapping card hands into individual card hands.

Figure 11:
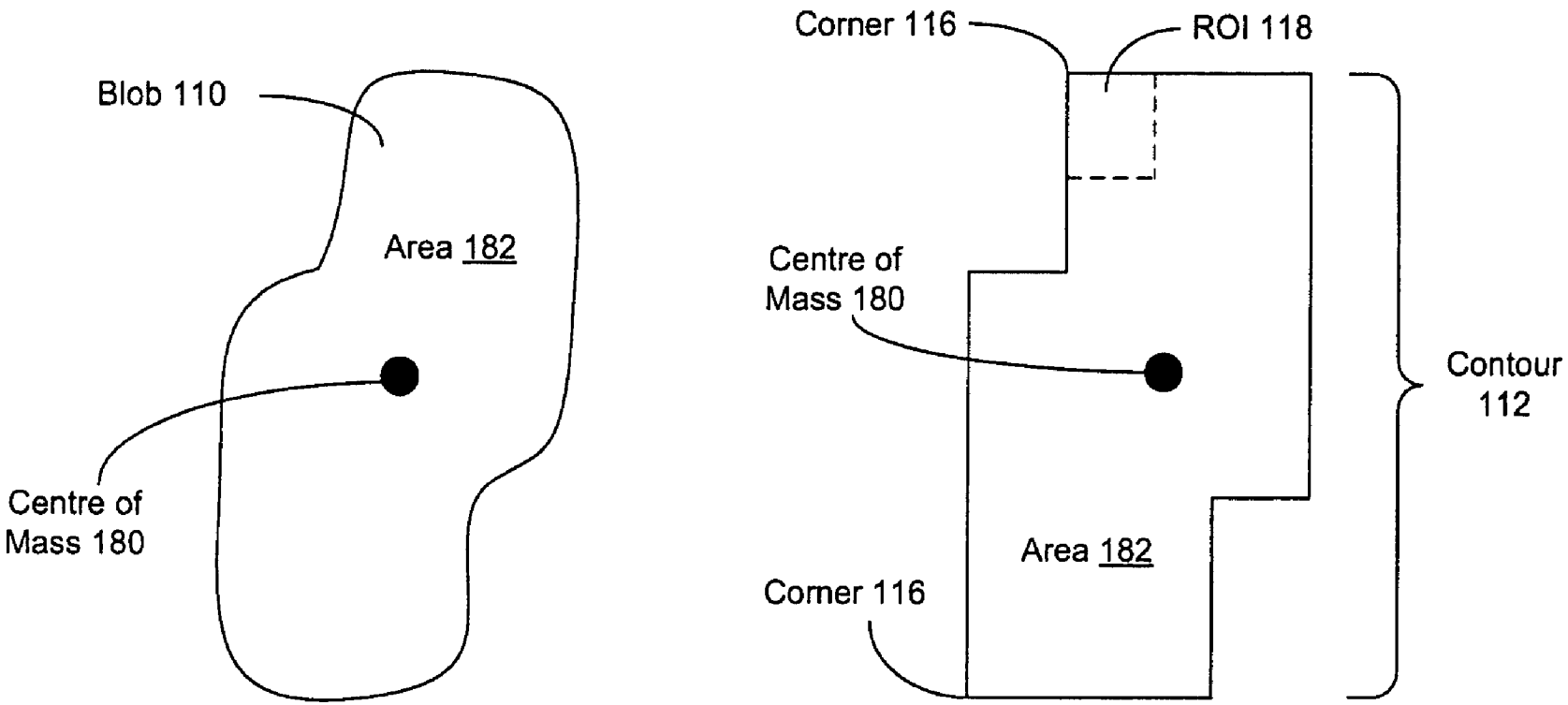
FIG. 11 is a plan view of card hand representations with positioning features.

With regard to object modeling the IP module 80 provides positioning features that can be utilized to model cards and track cards from frame to frame. Referring now to FIG. 11 a plan view of card hand representations with positioning features is shown. A centre or mass 180 is shown as a positioning feature but other features such as ROI 118, corners 116, line segments 114, shapes or partial shapes of numbers, patterns and pips on the card may be utilized.

Object representation or modeling refers to the parameters that can describe the object in each frame. Different aspects of the object can be represented, such as its shape or appearance. For modeling object boundaries, deformable contours (Witkin, A., Kass, M, and Terzopoulos, D. 1988. *Snakes: Active contour models. International Journal of Computer Vision,* 1(4):321-331) is an example representation that may be utilized. As other examples, coarse contour representation, ellipses, superquadrics, or B-splines can be used. The mentioned techniques for representing a contour define a set of parameters that can describe the contour. For example, in the case of deformable contours or B-Splines, the parameters are usually a sequence of points. In the case of ellipses or superquadrics, the parameters are usually the axes dimensions and various deformation parameters, such as the angle of rotation or bending parameters. In general, some optimization techniques can be used to fit the parameterized model to the actual contour. A contour can become partially occluded. For example, a dealer's hand may partially obstruct the overhead view and occlude a part of a card hand contour. Some features can still be representative of a card hand, even if only part of it is visible. In the case of contours, such features include the portions of the contour, which are unique in shape, such as a corner. Since under partial occlusion some of these distinguishing features would likely still be visible, the partially occluded hand could likely be matched using a subset of card hand features. For low resolution data, features such as the curvature of the bounding contour could be used for tracking. Object modeling can group together different features to model an object. For instance, a group of corners and associated line segments can be collectively modeled as one card hand, and that way if some of the features within that group of features are not available because of occlusion, the remaining features will be sufficient to track the cards.

An object's model may not necessarily contain a static group of features. The model can be dynamic and can be updated and expanded with new data as it becomes available or as the existing position features change from frame to frame. As an example, after recognition of ROI 118 (see FIG. 7), specific positioning features (such as geometrical and/or pattern features) detected on the rank and suit inside the ROI 118 may be added to the object's model. An example of a geometrical feature is strong corners obtained through Eigenvalues on a card suit image. An example of a pattern feature is Hu moments and Zernike moments obtained on an image of a card's interior pattern. As another example, if an object is slightly rotated, thus causing its position features to change slightly, the object's model can be updated with the new position features.

Object motion tracking generally refers to tracking an object that is moving from frame to frame in a temporal sequence of image frames. The position and/or other parameters of the object are being tracked through consecutive or periodic frames. In case of card tracking, the objects in question are cards or card hands. Object motion tracking matches positioning features of objects over consecutive frames. Based on this comparison of consecutive frames, it is possible to track a moving hand that is shifted on gaming table 12. An assumption that tracking methods rely on is that an object's positioning profile (comprised of positioning features such as corners, ROIs, or line segments) for consecutive frames are similar to each other. Based on this assumption, comparison of position profiles between one or more consecutive frames can be utilized to establish compatibility. A compatibility of position profiles can indicate that the compared position profiles represent the same gaming object. Once compatibility has been established for position profiles of gaming objects between two (or more) frames, the identity of the gaming object from the first frame can be assigned to the gaming object in the second frame, thus eliminating the need for performing recognition of the gaming object in the second frame. An advantage of object motion tracking is that it can potentially improve speed of game monitoring by reducing the number of recognitions that need to be done by the described technique of assigning the identity after establishing compatibility between position profiles.

One type of positioning feature or groups of positioning features is a shape descriptor. A shape descriptor approximately defines the shape of a gaming object. A contour is an example of a shape descriptor. The four corner points of a playing card is another example.

One motion tracking technology is optical flow (B. Horn and B. Schunck. *Determining optical flow, Artif. Intell.*, vol. 17, pp. 185-203, 1981). Based on frame differencing, each point in every frame is assigned a velocity. For card tracking, such data could be used to better estimate the motion of a card or a card hand and help keep track of its position parameters. Tracking methods can account for effects such as occlusion, by being able to track the object based on only a subset of object positioning features at each frame. Examples of some available tracking techniques used include Kalman Filtering and Condensation (*CONDENSATION—conditional density propagation for visual tracking*, Michael Isard and Andrew Blake, *Int. J. Computer Vision,* 29, 1, 5-28, 1998).

One possible motion tracking approach that deals with occlusion is the layered approach. An example of such layered tracking is by B. J. Frey, N. Jojic and A. Kannan 2003 *Learning appearance and transparency manifolds of occluded objects in layers, In Proceedings of IEEE conference on Computer Vision and Pattern Recognition,* 2003. (*CVPR* 03). Each hand can be tracked using a separate layer. The larger contour containing overlapping hands may be tracked or detected using a combination of layers of individual cards or individual card hands.

With regard to the points in contour test, in an embodiment of the present invention, cards and card hands are modeled with contours and/or card corner points. The points in contour test may be utilized to:

a) Determine if the card or card hand might be occluded;

b) Determine the minimum number of cards in a card hand contour; and c) Ascertain if a contour is likely that of a card hand.

Before discussing an implementation of a points in contour test we first refer to some basic concepts.

Figure 12:
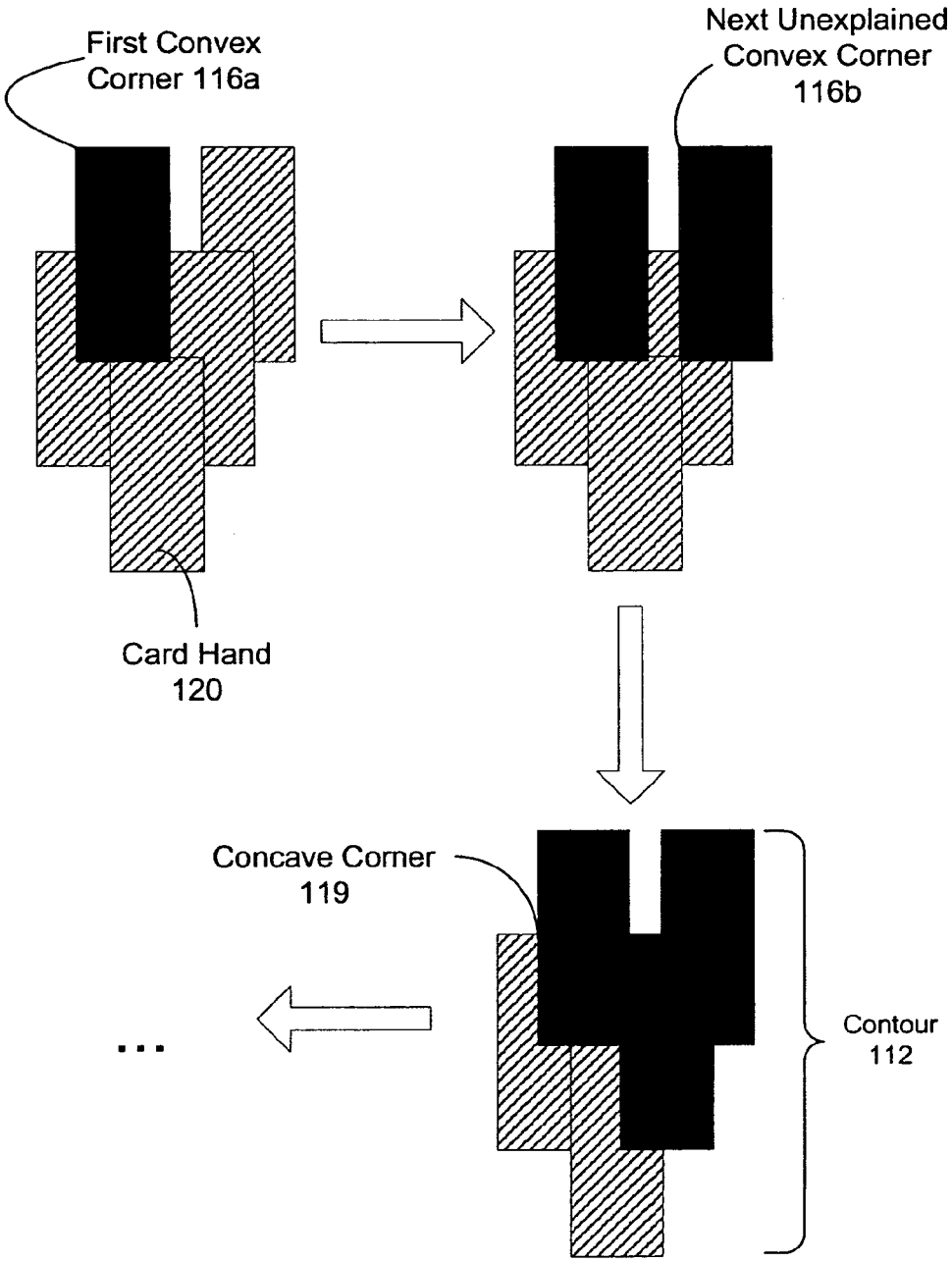
FIG. 12 is an illustrative example of applying corners in a contour test.

Referring now to FIG. 12 an illustrative example of applying corner points in a points in contour test is shown. There are two types of corners, convex corners and concave corners. A convex corner is the corner of a card, a concave corner is a corner within a contour 112 that is not a card corner. In FIG. 12, contour 112 of card hand 120 has sixteen corners, ten of which are convex and six of which are concave. As shown in FIG. 12, a card is identified by a first convex corner 116*a* and processing moves to each unexplained convex corner in turn until as many cards as fully visible in a card hand 120 are detected. In the example shown in FIG. 12, the next unexplained convex corner after 116*a* would be 116*b* and so on. Concave corners such as 119 are not examined to identify cards in this embodiment.

Figure 13:
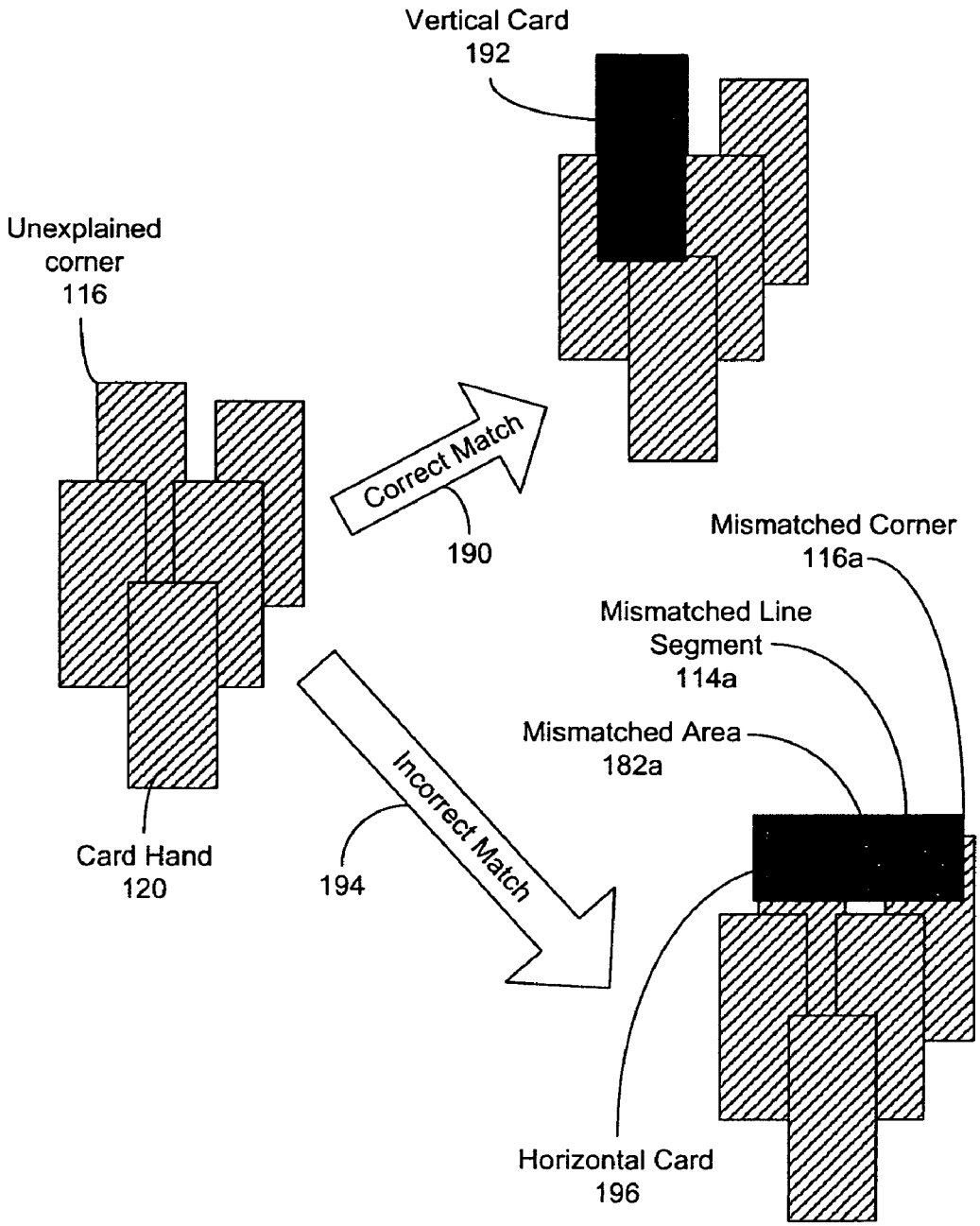
FIG. 13 is an illustrative example of matching vertical and horizontal card orientations.

Referring now to FIG. 13 an illustrative example of matching vertical card and horizontal card orientations is shown. As shown in feature 190 a vertical card 192 correctly matches the contour of card hand 120. In the case of feature 194 a horizontal card 196 does not match the contour of card hand 120, as mismatched corner 116*a*, mismatched line segment 114*a* and mismatched area 182*a* do not match the contour of hand 120. It is to be noted that it is not necessary that each of features 116*a*, 114*a* and 182*a* need to be checked. A subset of them can be checked. Alternatively, the process can begin with an unexplained line segment and try to match line segments using a line segment in contour test, whereby one or more of corresponding lines can be superimposed.

Figure 14:
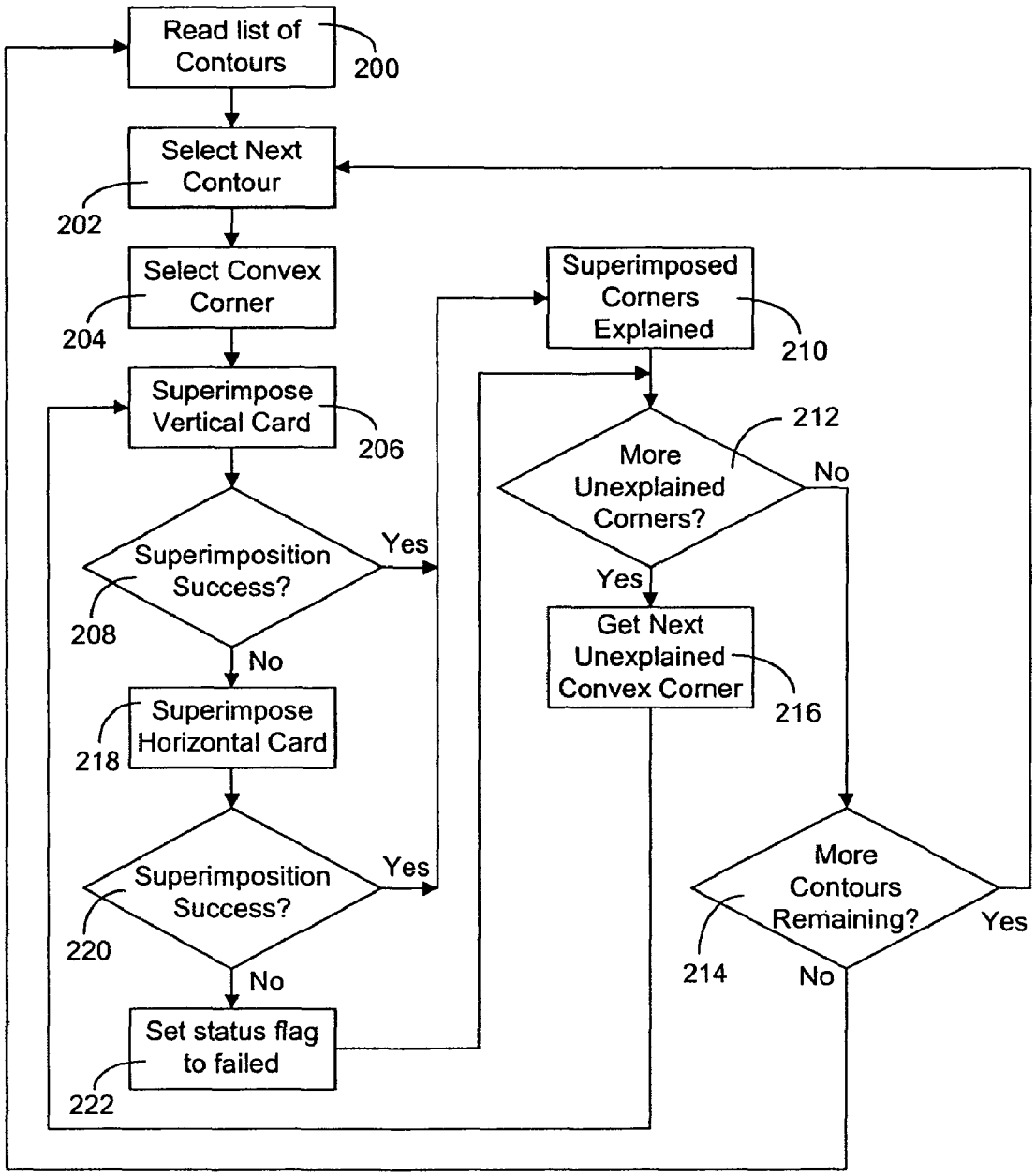
FIG. 14 is a flowchart of a points in contour test.

Referring now to FIG. 14 a flowchart of a points in contour test is shown. Beginning at step 200 a list of contours that may be card hands is determined based upon object positioning information received from the IP module 80. At step 202 a contour is selected. At step 204 a convex corner (i.e. a card corner) of the contour is selected. Moving to step 206 the corners of a card are interpolated based upon the convex corner selected and a vertical card is placed on the contour to determine if it fits inside the contour. At step 208 if the vertical card fits inside the contour, processing moves to step 210 where the corners of the contour that match the vertical card are marked as explained. At step 212 a test is made to determine if there are anymore unexplained convex corners. If no more unexplained convex corners exist processing moves to step 214 where a test is made to determine if any more contours exist to be examined. If at step 214 the result is yes, processing moves to 202 and if no, processing moves to step 200. Returning to step 212 if there are more unexplained convex corners, processing moves to step 216 where the next unexplained convex corner is detected and processing then returns to step 206.

Returning to step 208 if the vertical superimposition is not successful, processing moves to step 218 where the corners of a card are interpolated based upon the convex corner selected and a horizontal card is placed on the contour to determine if it fits inside the contour. At step 220 a test is made to determine if the horizontal card fits the contour. If the superimposition was successful processing moves to step 210 as discussed above. If it was not successful a flag is set at step 222 to indicate the matching of a corner failed and processing moves to step 212. The flags set at step 222 can be used by game tracking module 86 to determine if a card hand is occluded. The flags set at step 222 can also be used by a recognition method of the IP module to perform recognition only on cards or card hands that are not occluded. In the embodiment of the IP module with a card shoe reader 24 and array of proximity sensors 170, the number of cards in a card hand as determined by the points in contour test can be utilized to assign a new card that has come out of the shoe to the appropriate card hand.

The number of times the point in contours method is repeated is an indication of the minimum number of cards in a card hand. If the points in contour method fails for one or more corners, it could mean that the contour does not belong to a card/card hand or that the contour may be occluded.

Figure 15:
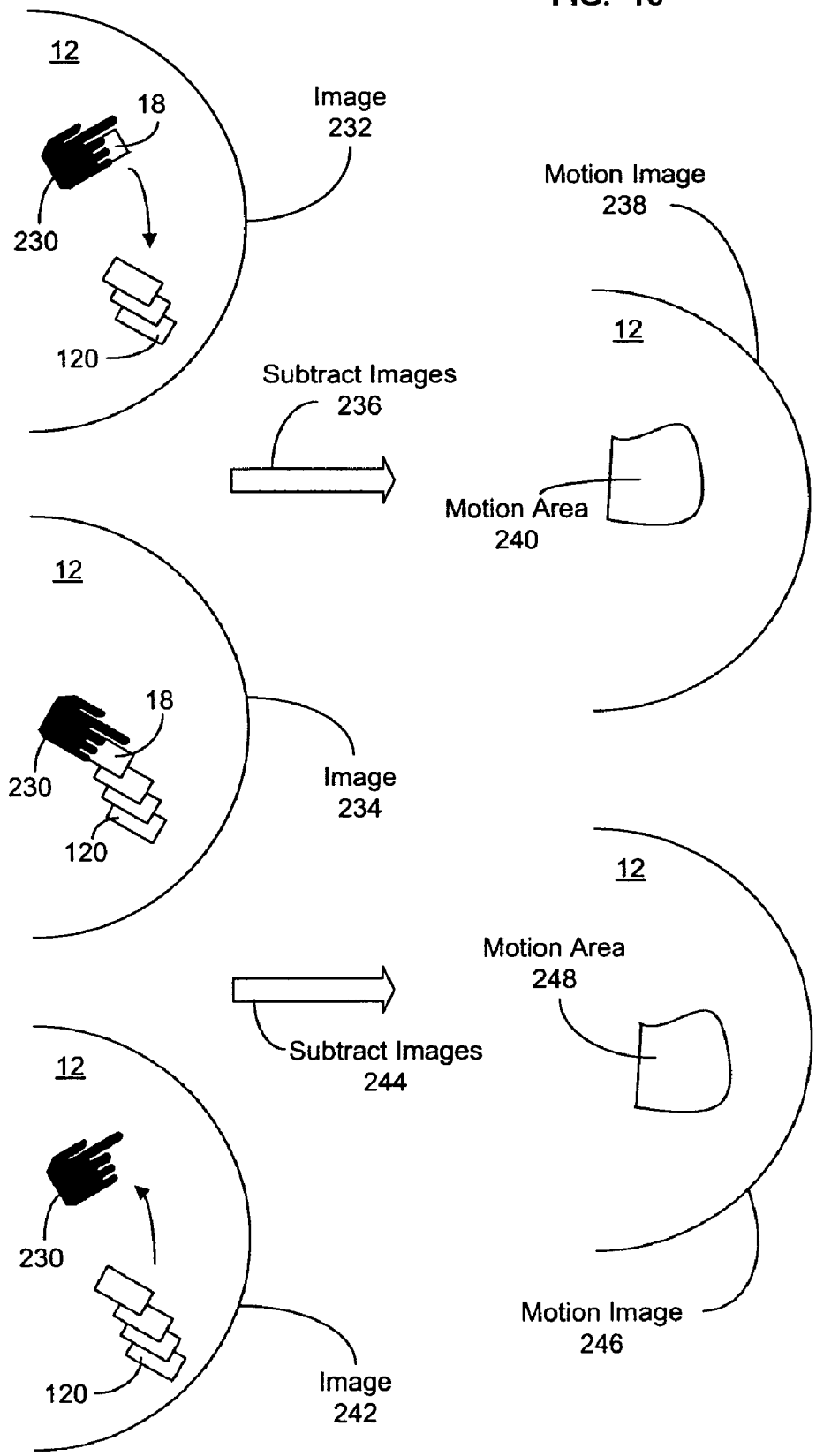
FIG. 15 is an illustrative example of detecting frame differencing through motion detection.

Motion detection (different from object motion tracking) in the vicinity of the card or card hand position feature can be performed by comparing consecutive frames. Frame differencing is a method to detect motion, whereby from the most recent image, one or more temporally previous images may be subtracted. This difference image shows one or more areas of potential motion. We now refer to FIG. 15 as an illustrative example of detecting frame differencing through motion detection. The hand of a dealer dealing a card 18 to a card hand 120 is shown as feature 230. The motion of the dealer about to deal card 18 is captured as image 232. Image 234 indicates the position of card 18 and the dealer hand 230 once the card 18 has been added to card hand 120. By subtracting image 232 from image 234 as shown by feature 236, a motion image 238 is generated defining a motion area 240.

As shown in image 242 the hand of the dealer 230 has been removed from the card hand 120 as shown in image 242. By subtracting image 234 from image 242 as shown by feature 244, a motion image 246 is generated defining a motion area 248.

Motion detected on or right beside an object positioning feature (such as a contour) of a card or card hand can be an indication that the card or card hand may be occluded and an appropriate motion flag can be set to record this potential occlusion.

Figure 16:
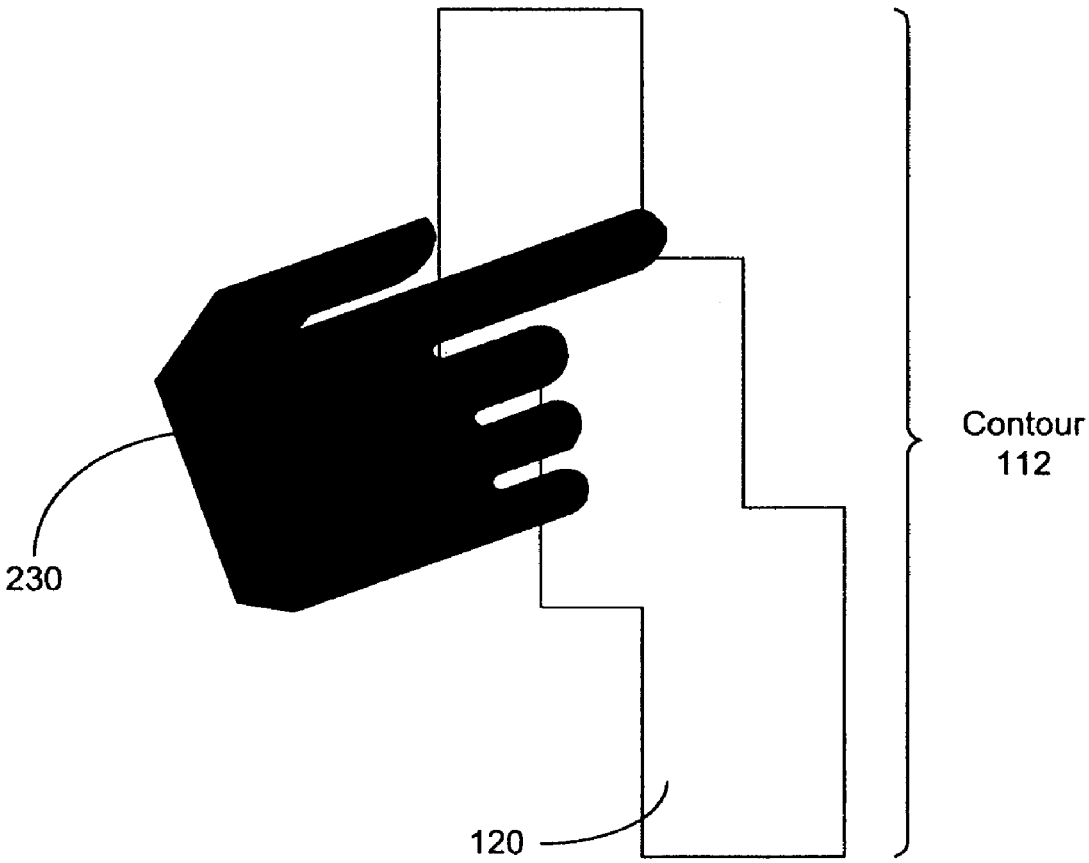
FIG. 16 is an illustrative example of a the hand of a dealer occluding the contour of a card hand.

Skin color detection algorithms on images can be utilized to detect hands of a player or dealer. If the hand of a player or dealer is on or right beside an object position feature of a card hand, it can be deciphered that the card or card hand can be partially or entirely occluded. Numerous skin color detection algorithms on images are readily available in the public domain. Non-parametric skin distribution modeling is an example of a skin detection algorithm that may be utilized. It must be noted that skin detection may not be sufficiently accurate if the table layout is brown or skin like in color or has skin colored patterns. Referring now to FIG. 16 an illustrative example of a dealer hand occluding the contour of a card hand is shown.

Analysis of a contour 112 of a card 18 or card hand 120 can be utilized to determine if it is occluded. The same is true for any gaming object. The values of the flags set by the points in contour test, motion detection, skin detection and contour analysis can be utilized to detect potential occlusion of a card or card hand. It is not necessary to utilize all of these occlusion detection methods. A subset of these methods may be utilized to detect potential occlusion. As shown in FIG. 16 the hand of the dealer 230 has occluded the contour 112 of the card hand 120.

Figure 17:
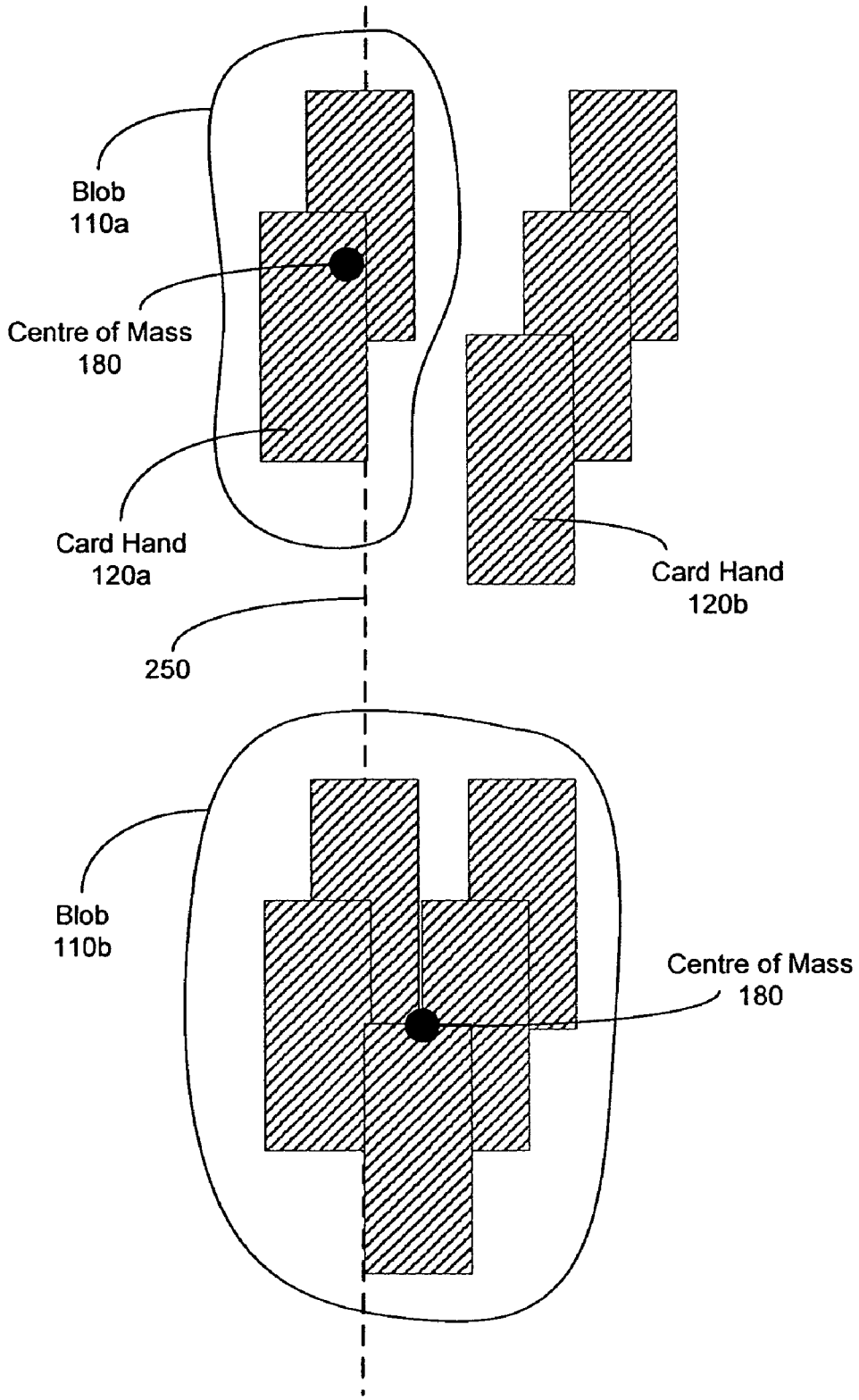
FIG. 17 is an illustrative example of changes in blob properties.

During the course of a game, occasionally, two individual card hands may overlap resulting in a single contour representing both card hands. One way to detect an overlap of card hands is to utilize object motion tracking, as described in a foregoing section, to track identified card corners (or contours or other position features) gradually as they move and end up overlapping another card hand. For instance, with reference to FIG. 17 an illustrative example of changes in blob properties is shown. A card hand 120*a* may be moved by the dealer and result in overlapping with card hand 120*b*. One method to determine the occurrence of an overlap is to detect changes in area, centre of mass, and other geometrical parameters of blobs or contours. When two hands overlap there is normally a very large increase in the area of the resulting merged contour or blob as compared to the area of the original contour. As is shown in FIG. 17, as indicated by reference line 250, centre of mass 180 moves to the right when card hands 120*a* and 120*b* overlap and the resulting blob 110*b* is larger than blob 110*a*.

Figure 18:
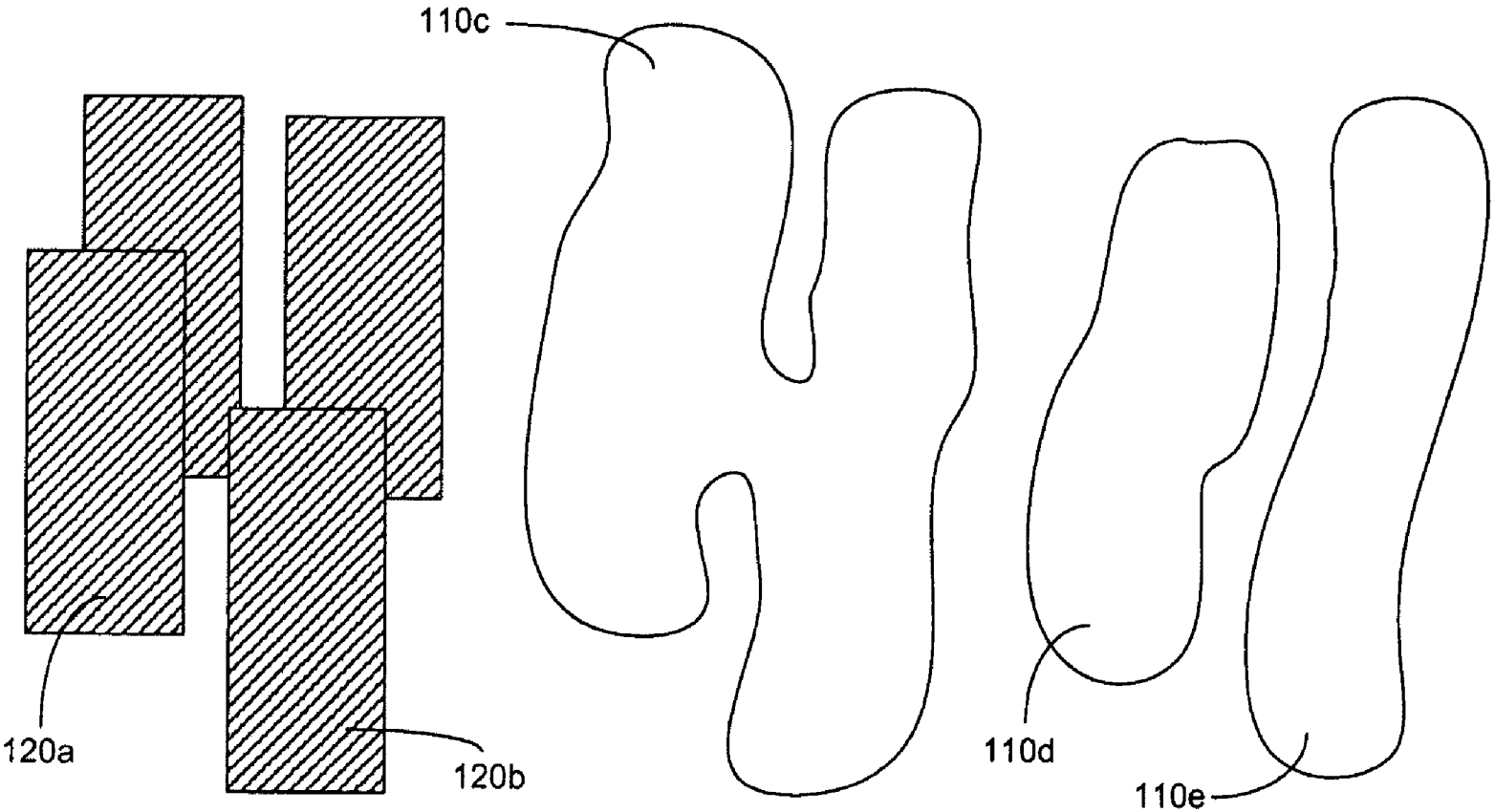
FIG. 18 is an illustrative example of applying erosion.

If two contours or blobs are overlapping by a small area, then an erosion algorithm may be utilized to separate blobs/contours into separate card hands. Erosion is an image processing filter that can iteratively shrink the contour or blob. Shrinking is done in such a way that narrow portions of the contour disappear first. Erosion may be utilized as a technique to separate blobs/contours into separate card hands. FIG. 18 is an illustrative example of applying erosion. As shown in FIG. 18 two overlapping card hands 120*a* and 120*b* resolve to a single blob 110*c*. By applying erosion, blob 110*c* is separated into two blobs 110*d* and 110*e* representing card hands 120*a* and 120*b* respectively.

Figure 19:
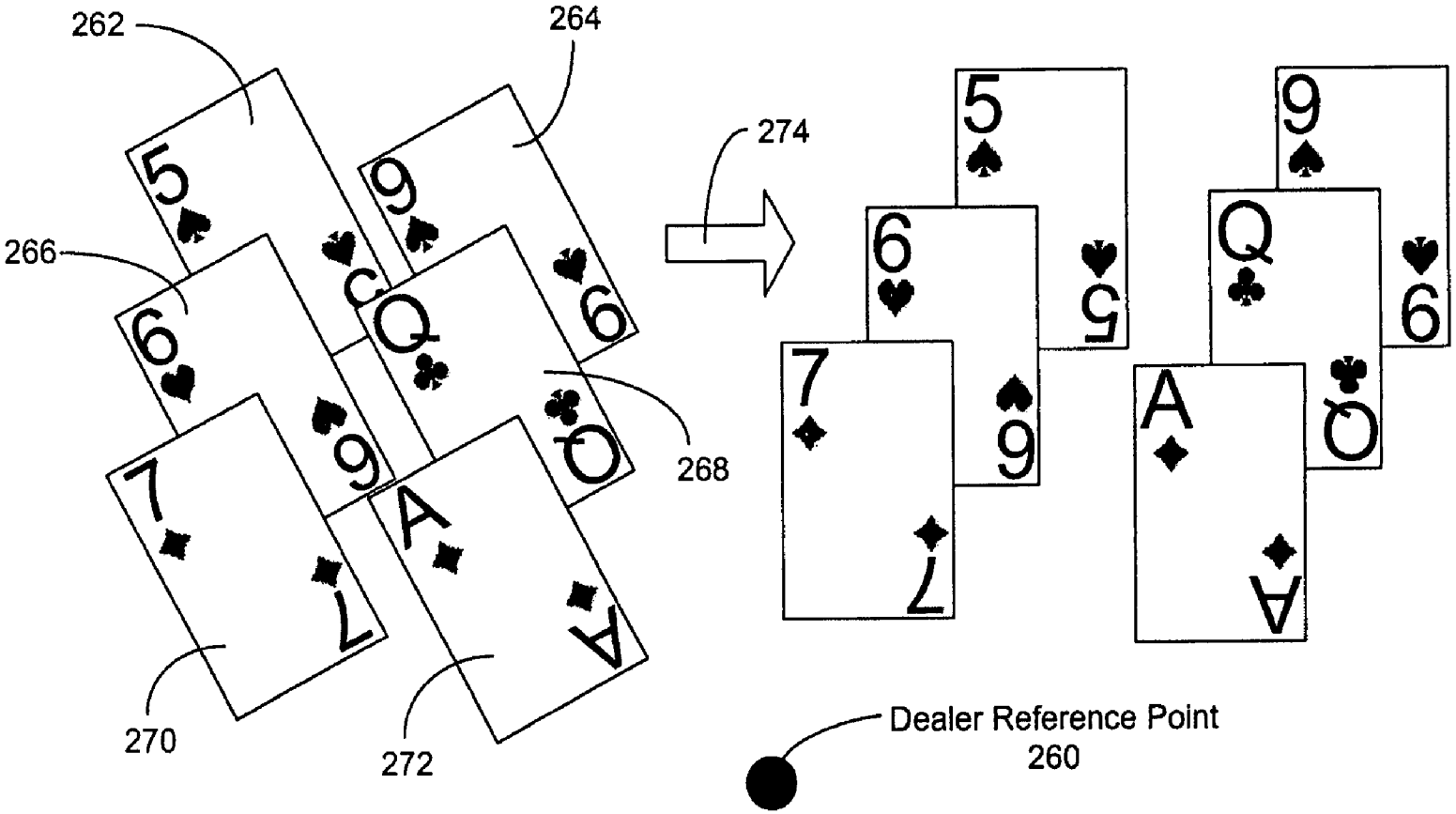
FIG. 19 is an illustrative example of the separation of two card hands.

Referring now to FIG. 19 an illustrative example of the separation of two card hands is shown. Given a single contour formed by one or more individual card hands, the identified cards and position features can be utilized to separate the hands using known properties of how a table game is dealt. For instance, in the game of Blackjack, the dealer usually deals cards in a certain fashion, as shown in FIG. 19. The cards can be ordered in decreasing distance from the dealer reference point. The dealer reference point 260 can be located at the bottom center of the chip tray. The ordered list of cards as shown in FIG. 19 is: five spade 262, nine spade 264, six heart 266, queen club 268, seven diamond 270, and ace diamond 272 based upon dealer reference point 260. Arrow 274 indicates how the card hands dealt may be eventually rotated and separated into separate card hands. It is to be noted that in alternate embodiments ordering of the cards can be done with reference to different reference points depending on the location of a card hand. As an example, if a card hand is located closest to the first betting spot, the cards in that hand can be ordered in increasing distance from a reference point located above the first betting spot.

Figure 20:
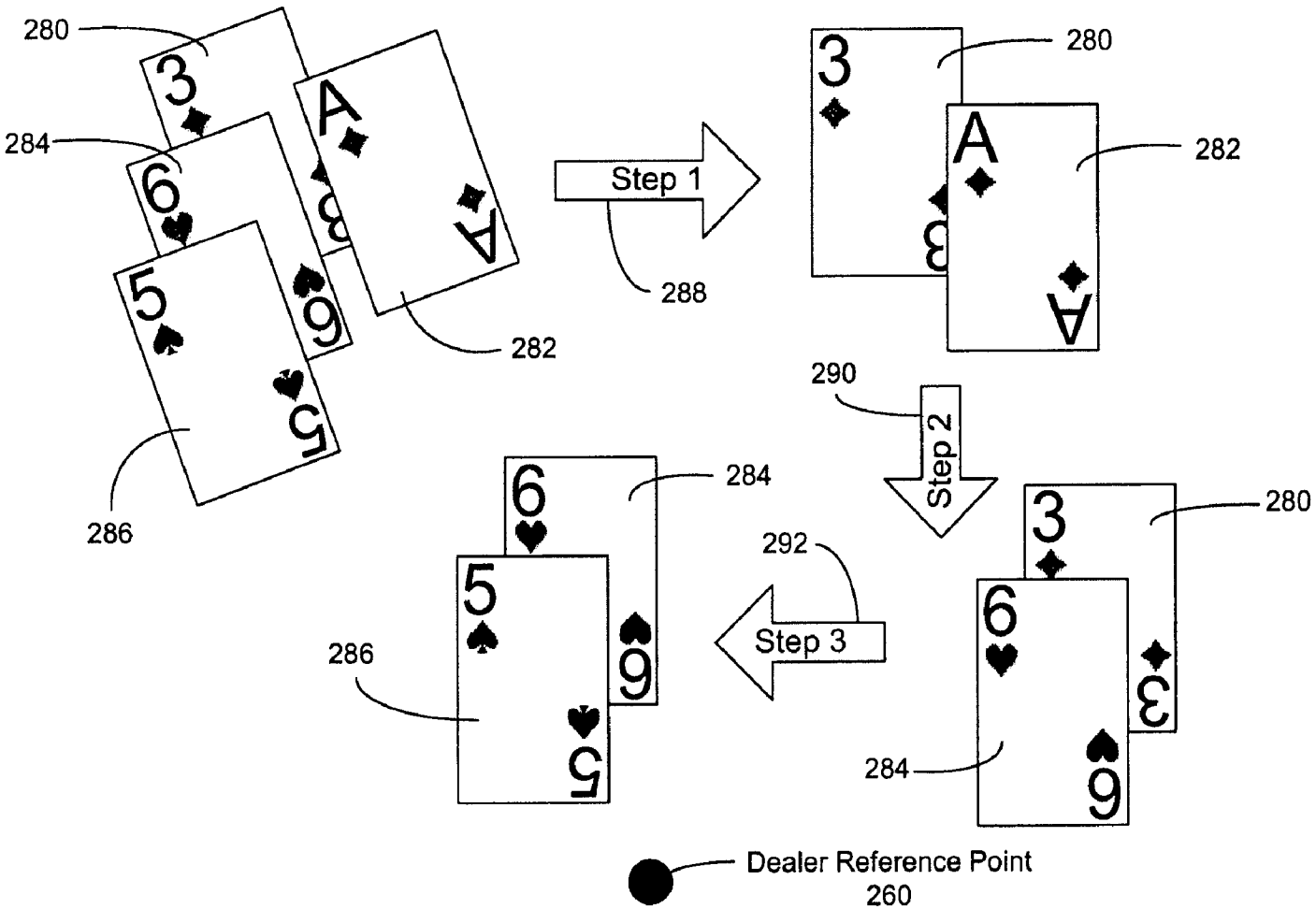
FIG. 20 is an illustrative example of pair-wise rotation and analysis.

Referring now to FIG. 20 an illustrative example of pairwise rotation and analysis is shown. Cards 280, 282, 284 and 256 are selected in the order of furthest away from the dealer reference point 260 to the closest to the dealer reference point 260. The ordered list of cards shown in FIG. 20 would be: three diamond 280, ace diamond 282, six heart 284, and five spade 286. Each consecutive pair of cards is checked for a valid card configuration as shown by features 288, 290 and 292. One of these pairs is not a valid card configuration. In order to check for a valid card configuration, the cards are first rotated and this rotation is performed for every pair of cards that are compared.

The first two cards, three diamond 280 and ace diamond 282 are rotated upright at step 288 and the valid card configuration checked. If the configuration passes, the next pair of cards is checked at step 290. This configuration fails and the failed card (ace diamond 282) is removed from the card hand and made into a temporary separate card hand. The card configuration failed because according to Blackjack card configuration rules the new card should be placed to the bottom left, and not the bottom right of the previous card. The next pair of cards, three diamond 280 and six heart 284 are then checked. Here as the configuration is a valid Blackjack card configuration. At step 292, the next pair of cards, six heart 284 and five spade 286 are checked, which also pass the valid card configuration. Ultimately, the cards get separated into two hands, each with valid blackjack card hand configuration. The first hand comprises three cards, three diamond 280, six heart 284 and five spade 286, while the second hand comprises one card, ace diamond 282.

Figure 21A:
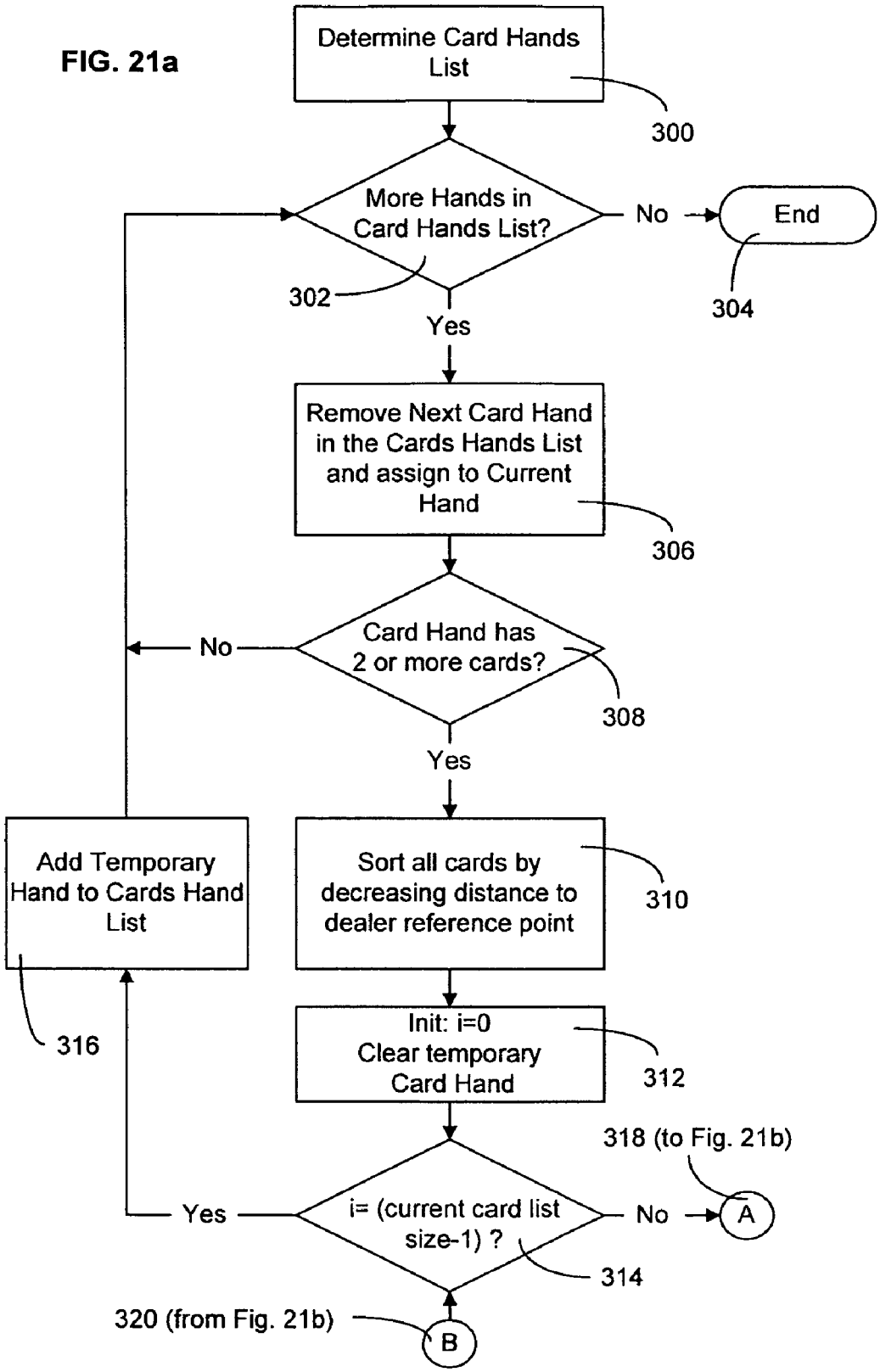
FIGS. 21*a* and 21*b* are flowcharts of a card hand separation process.
Figure 21B:
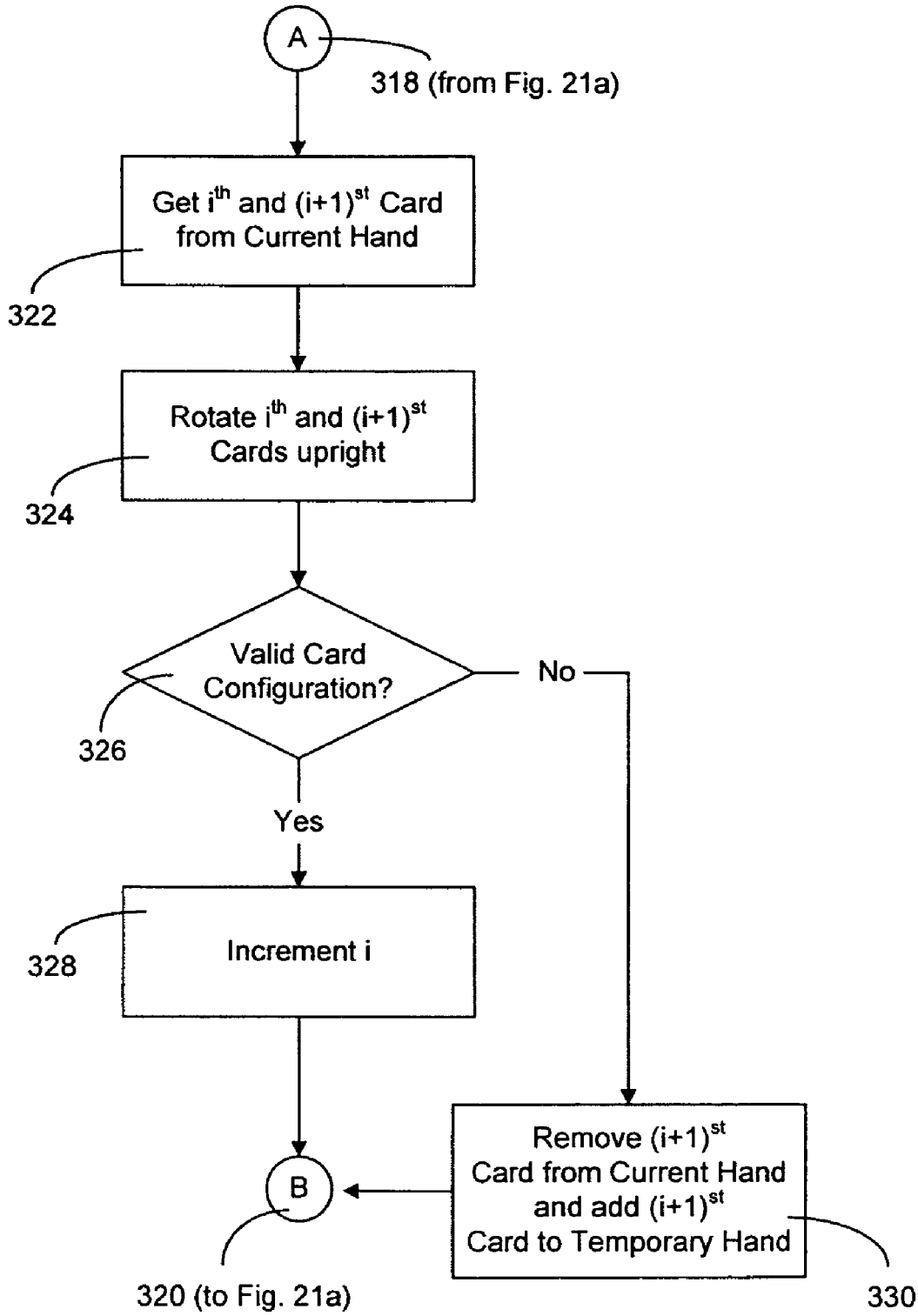

FIGS. 21*a* and 21*b* are flowcharts of a card hand separation process as described with reference to FIG. 20. Beginning at step 300, identity and positioning information of cards and card hands is received from the IP module 80, from which a card hands list is determined. From the example of FIG. 20 one contour of a card hand containing cards 280 to 286 can be separated into two actual card hands—280,284,286 as one card hand and 282 as another card hand. At step 302 a test is made to determine if there are any more card hands to analyze in the card hands list. If not, processing ends at step 304. If there are more card hands to analyze processing moves to step 306. At step 306 the next card hand in the card hands list is removed and assigned to a current card hand. At step 308 a test is made to determine if there are more than two or more cards in the current hand. If not processing returns to step 302 otherwise processing moves to step 310. At step 310 the cards in the current card hand, in our example cards 280 to 286 are sorted by decreasing distance to the dealer reference point 260. At step 312 a temporary card hand is created and a counter "i" is initialized to zero to point to the first card of the sorted list of cards in the current card hand. At step 314 a test is made to determine if the counter "i" has reached the last card in the current hand. If the test at step 314 is successful processing moves to step 316 where a temporary hand (i.e. a hand including cards that do not appear to be of the current card hand) is added to the card hands list. If the test at step 314 is negative processing moves to step 322 of FIG. 21*b*. At step 322 the current and next card are selected from the current hand. At step 324 the cards selected at step 322 are rotated upright. At step 326 a test is made to determine if the two selected cards form a valid card pair configuration as per the dealing procedures of the game (Blackjack in this case). If not processing moves to step 330 where the next card in the pair is removed from the current hand and placed in the temporary hand and then back to step 314 of FIG. 21*a*. If the test at step 326 is successful, the value of the current card ("i") is incremented at step 328 and processing moves to step 314 of FIG. 21*a*.

In the foregoing embodiment of the card hand separation process, the cards 280 to 286 in the card hand are first sorted according to their distance from a reference point 260 before they are compared pair wise and separated if necessary. In an alternate embodiment, the cards 280 to 286 may first be compared pair wise and separated into different card hands (if necessary), after which the cards in each resulting card hand may be ordered by sorting according to their distance from a reference point 260.

In the foregoing embodiments of the card hand separation process, the cards 280 to 286 in the card hand are separated based on the present data from the IP module 80 and without prior knowledge of the game state or other data frames. In an alternate embodiment, the separation process may analyze one or more of the following parameters—current game state, previous game state, data from the IP module 80 from temporally different points including past and future with respect to the current data frame.

Although the foregoing methods illustrate how overlapping card hands can be separated into distinct card hands, it must be noted that the described card hand organization techniques can generally be applied to organize a number of cards into card hands. For instance, in an embodiment of the IP module 80 with RFID embedded playing cards, the data from the IP module 80 might not contain contour information. In this embodiment the described card hand organization methods may be utilized to organize the identity and position profiles of cards into distinct card hands.

We shall now discuss the functionality of the game tracking (GT) module 86 (see FIG. 6). The GT module 86 processes input relating to card identities and positions to determine game events and game states.

The GT module 86 can have a single state embodiment or a multiple state embodiment. In the single state embodiment, at any given time in a game, one valid current game state is maintained by the GT module 86. When faced with ambiguity of game state, the single state embodiment forces a decision such that one valid current game state is chosen. In the multiple state embodiment, multiple possible game states may exist simultaneously at any given time in a game, and at the end of the game or at any point in the middle of the game, the GT module 86 may analyze the different game states and select one of them based on certain criteria. When faced with ambiguity of game state, the multiple state embodiment allows all potential game states to exist and move forward, thus deferring the decision of choosing one game state to a later point in the game. The multiple game state embodiment can be more effective in handling ambiguous data or game state scenarios.

Figure 22:
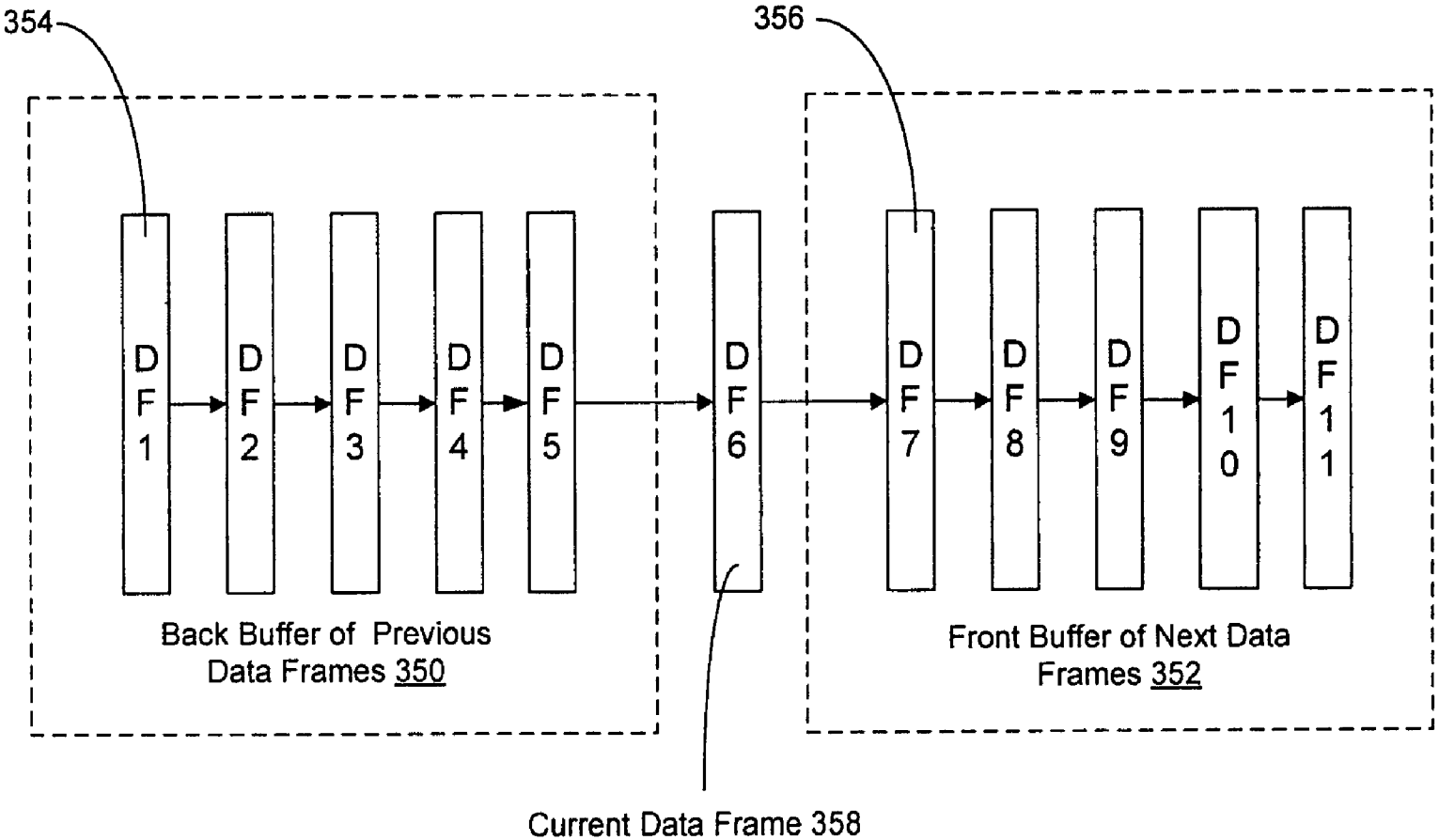
FIG. 22 is an illustrative example of the front and back buffer of data frames.

In order to determine states, GT module 86 examines data frames. Data frames comprise data on an image provided to GT module 86 from IP module 80 and IPAT, module 84. Referring now to FIG. 22 an illustrative example of the front and back buffer of data frames is shown. Data frames are queued in a back buffer 350 and a front buffer 352. Data frames in front buffer 352 have yet to be examined by GT module 86 while data frames in back buffer 350 have been examined. Data frame 354 is an example of a data frame in back buffer 350 and data frame 356 is an example of a data frame in front buffer 352. Current data frame 358 indicates a data frame being processed by GT module 86.

A data frame may include the following data:

a) Card and card hand positioning features (such as contours and corners)

b) Identity of cards, linked to the card positioning features c) Status flags (set by IPAT module 84) associated with the card and card hand positioning features.

GT module 86 utilizes data frames as described with regard to FIG. 22 to identify key events to move from one state to another as a game progresses. In the case of Blackjack, a key event is an event that indicates a change in the state of a game such as a new card being added to a card hand, the split of a card hand, a card hand being moved, a new card provided from a shoe, or removal or disappearance of a card by occlusion.

A stored game state may be valid or invalid. A valid state is a state that adheres to the game rules, whereas an invalid state would be in conflict with the game rules. During the game tracking process, it is possible that the current game state cannot account for the key event in the current data frame 358 being analyzed. The data frame 358 can contain information that is in conflict with the game rules or the current game state. In such an event, the current game state may be updated to account for the data in the frame 358 as accurately as possible, but marked as an invalid state. As an example in Blackjack, a conflicting data frame would be when IP module 80 or IPAT module 84 indicates that the dealer has two cards, while one of the players only has one hand with one card, which is a scenario that conflicts with Blackjack game rules. In this example, the dealer hand in the game state is updated with the second dealer card and the game is set to invalid state.

In the event of an invalid state or data frames with conflicting information, ambiguity resolution methods can be utilized to assist in accurately determining valid states. An embodiment of the present invention utilizes either or a combination of back tracking, forward tracking, and multiple game states to resolve ambiguities.

Figure 23:
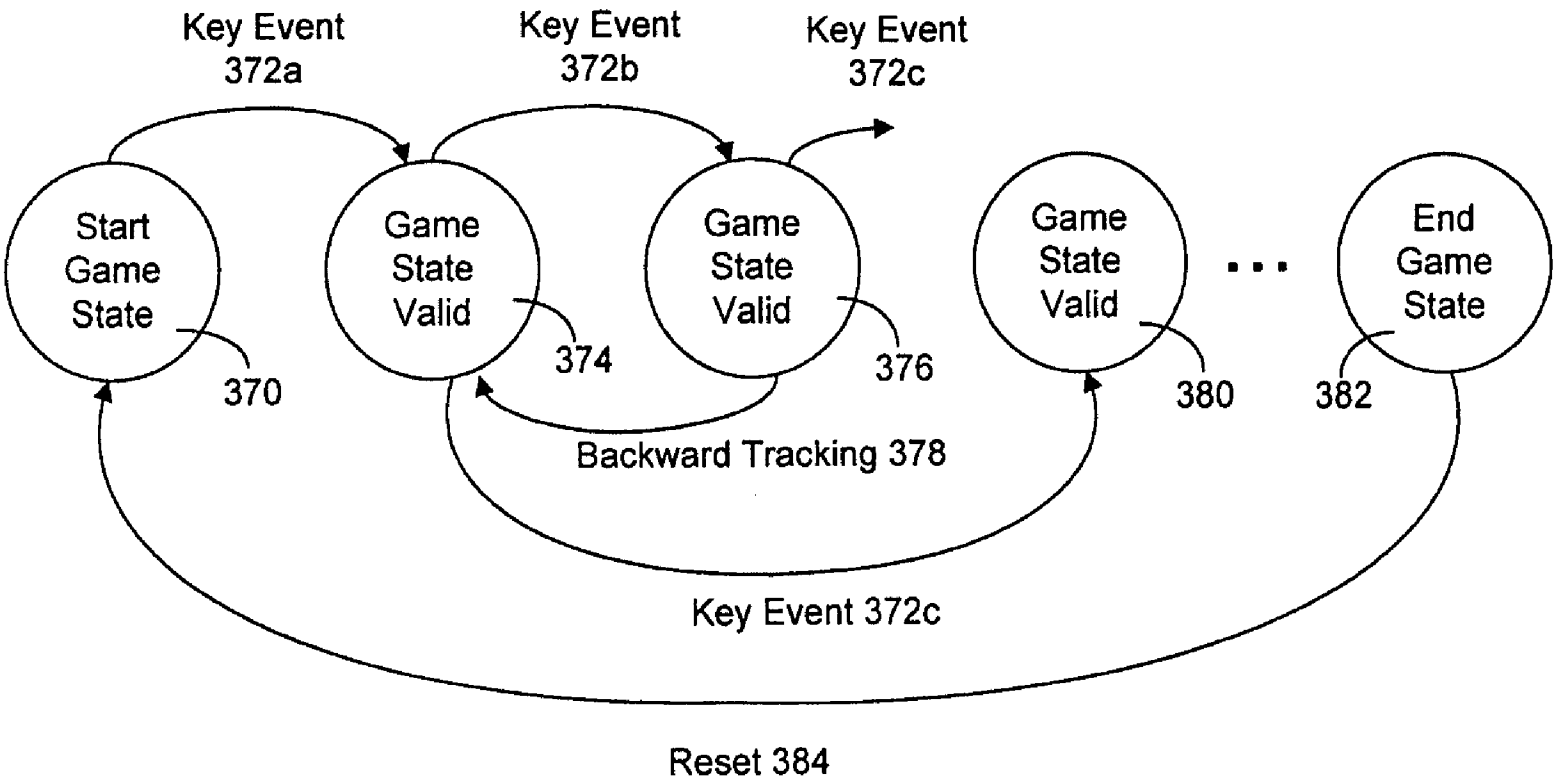
FIG. 23 is an illustrative example of states with backward tracking.

To further explain how backtracking may be utilized to resolve ambiguity with regard to key events and states we refer now to FIG. 23, an illustrative example of states with backward tracking. Beginning at state 370 a game is started. Based upon a key event 372*a*, which is discovered to be valid, the next state is 374. Key event 372*b* is also valid and the state 376 is established. Key event 372*c* is ambiguous with respect to state 376 and consequently cannot establish a new state. Feature 378 indicates backtracking to a previous game state 374 to attempt to resolve the ambiguity of key event 372*c*. At this point key event 372*c* is found to be not ambiguous with respect to game state 374 and the new state 380 is established based upon key event 372*c* to reflect this.

The use of backward tracking requires the system to store in memory previous game states and/or previous data frames. The number of temporally previous game states or data frames to be stored in memory can be either fixed to a set number, or can be variable, or determined by a key event.

Game states continue to be established until the game ends at game state 382 and reset 384 occurs to start a new game state 370.

Figure 24:
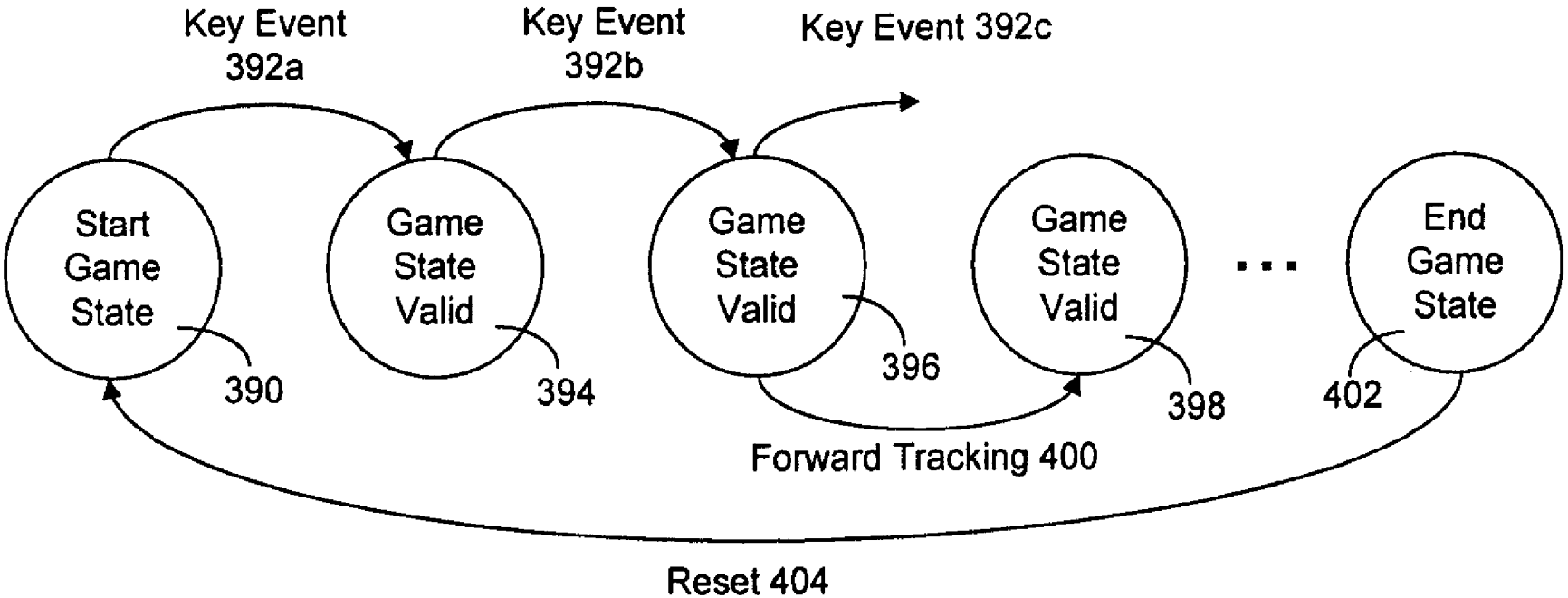
FIG. 24 is an illustrative example of states with forward tracking.

Referring now to FIG. 24 an illustrative example of states with forward tracking is shown. Beginning at state 390 a game is started. Based upon a key event 392*a*, which is discovered to be valid, the next state is 394. Key event 392*b* is valid which results in a valid game state 396. Key event 392*c* is determined to be ambiguous with respect to game state 396. As a result, the method forward tracks through the front buffer 352 of data frames and identifies a future key event in a data frame in front buffer 352. The combination of key events 392*c* and the future key event resolve the ambiguity, thus establishing next state 398. Feature 400 illustrates how ambiguity is resolved by looking for a valid future key event in front buffer 352 and combining it with key event 392*c*.

The forward tracking method requires the front buffer 352 (see FIG. 22) store data frames in memory that are temporally after the current frame 358 being analyzed. The number of frames to store information could either be fixed to a set number of data frames or can be variable.

Game states continue to be established until the game ends at game state 402 and reset 404 occurs to start a new game state 390.

Although backward tracking and forward tracking have been described as separate processes, they may be utilized in conjunction to resolve ambiguous data. If either one fails to establish a valid state, the other may be invoked in an attempt to establish a valid state.

Figure 25A:
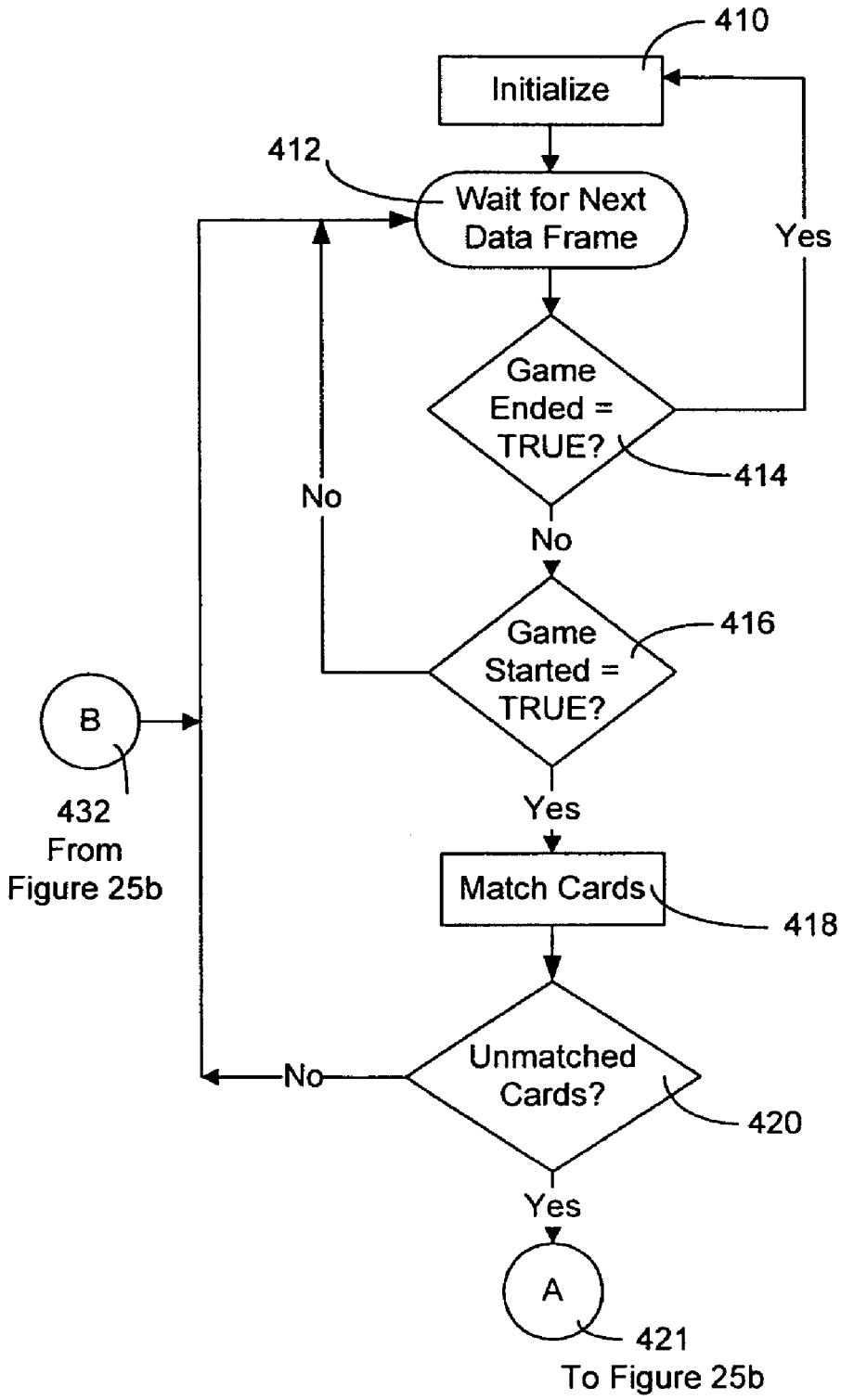
FIGS. 25*a* and 25*b* are flowcharts of the process of single state tracking.
Figure 25B:
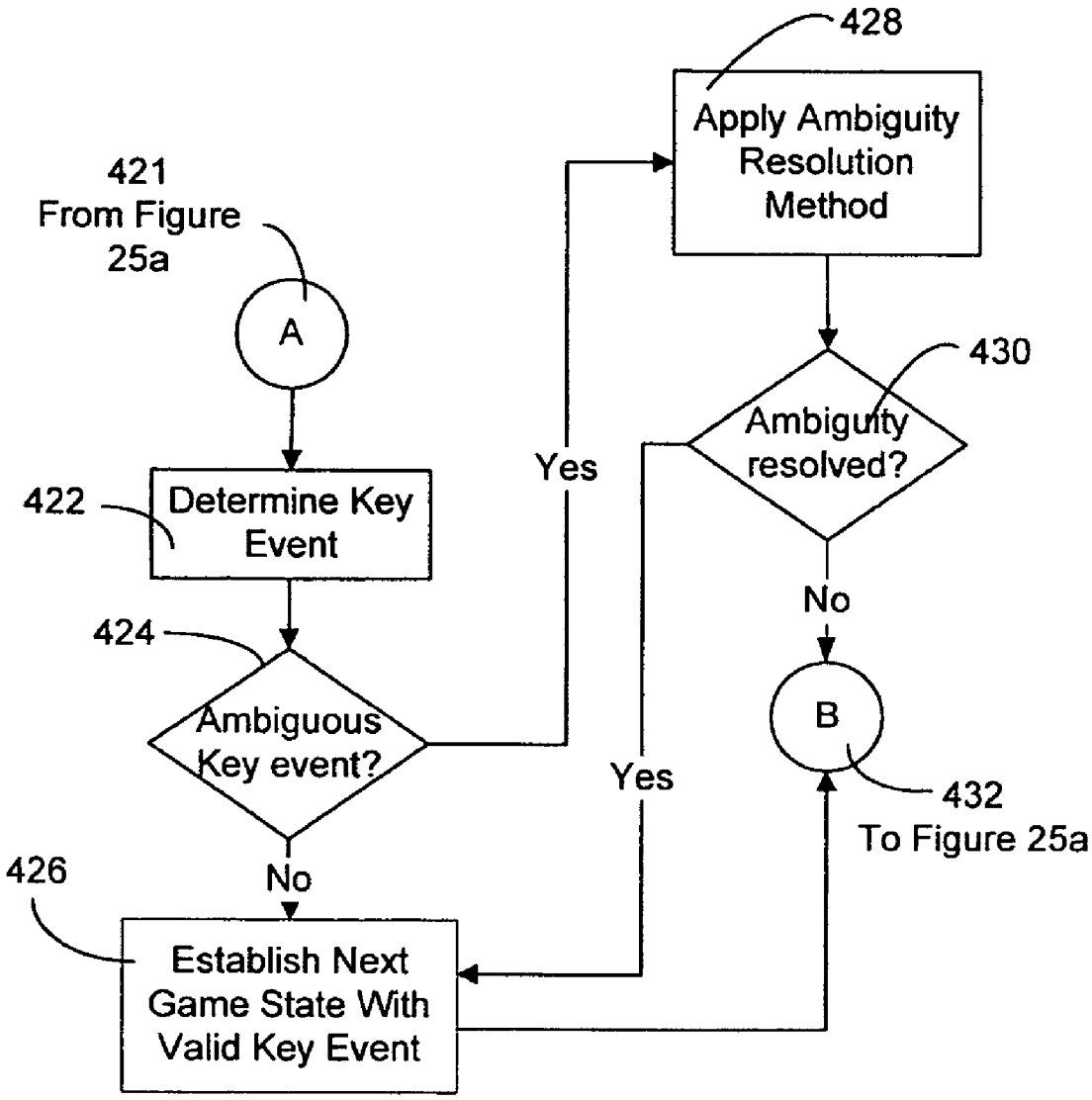

Referring now to FIGS. 25*a* and 25*b* a flowchart of the process of single state tracking is shown. Beginning at step 410 an initialization for the start of tracking a game begins. At step 410 one or more game state indicators are initialized. Examples of game state indicators would be that no card hands have been recognized, a game has not started or a game has not ended, or an initial deal has not been started. In the case of Blackjack an initial deal would be the dealing of two cards to a player. Processing then moves to step 412 where the process waits for the next data frame to analyze. At step 414 a frame has arrived and the frame is analyzed to determine if a game has ended. Step 414 may invoke one or more tests such as:

a) Is the dealer hand complete? In the case of Blackjack, if a dealer hand has a sum more than or equal to seventeen, the dealer hand is marked complete.

b) Is step a) met and do all player card hands have at least two cards?

c) A check of motion data to determine that there is no motion in the dealer area.

d) No cards in the current frame and no motion on the table could also indicate a game has ended.

If the game has ended then processing returns to step 410. If the game has not ended, then at step 416 a test is made to determine if a game has started. The test at step 416 may determine if the initial deal, denoted by two cards near a betting region 26, has occurred. If not, processing returns to step 412. If the game has started, then processing moves to step 418.

At step 418 the positioning features and identities of cards and card hands in the data frame are matched to the card hands stored in the current game state. The matching process can take on different embodiments such as priority fit. In the case of priority fit, card hands in the game state are ordered in priority from the right most hand (from the dealer's perspective) to the left most hand. In this ordering, the card hand at the active betting spot that is located farthest to the right of the dealer would have the highest pre-determined priority in picking cards/card hands in the data frame to match to itself. The right most card hand in the game state would pick the best match of cards/card hands from the data frame, after which the second right most card hand in the game state would get to pick the matching cards/card hands from the remaining cards/card hands in the data frame.

In an alternate embodiment of matching, a best fit approach can be used in order to maximize matching for all card hands in a game state. In the best fit approach, no specific card hand or betting location is given pre-determined priority.

In some cases a perfect match with no leftover unmatched cards or card hands occurs. This indicates that the incoming data frame is consistent with the current game state and that there has been no change in the game state.

Moving now to step 420 a determination is made as to whether there are any unmatched cards or card hands left from the previous step. If there are no unmatched cards or card hands the process returns to step 412. Unmatched cards or card hands may be an indication of a change in the game state. At step 422, the unmatched cards or card hands are analyzed with respect to the rules of the game to determine a key event. At step 424, if the determined key event was valid, the next game state is established at step 426, after which the process returns to step 412. Returning to step 424, if the key event is invalid or ambiguous then processing moves to step 428 where an ambiguity resolution method such as backtracking or forward tracking may be applied in an effort to resolve the ambiguity. At step 430 a test is made to determine if the ambiguity is resolved. If so, processing moves to step 426 otherwise if the ambiguity is not resolved, then a next game state cannot be established and as a result, processing returns to step 412 and waits for the next frame.

Figure 26:
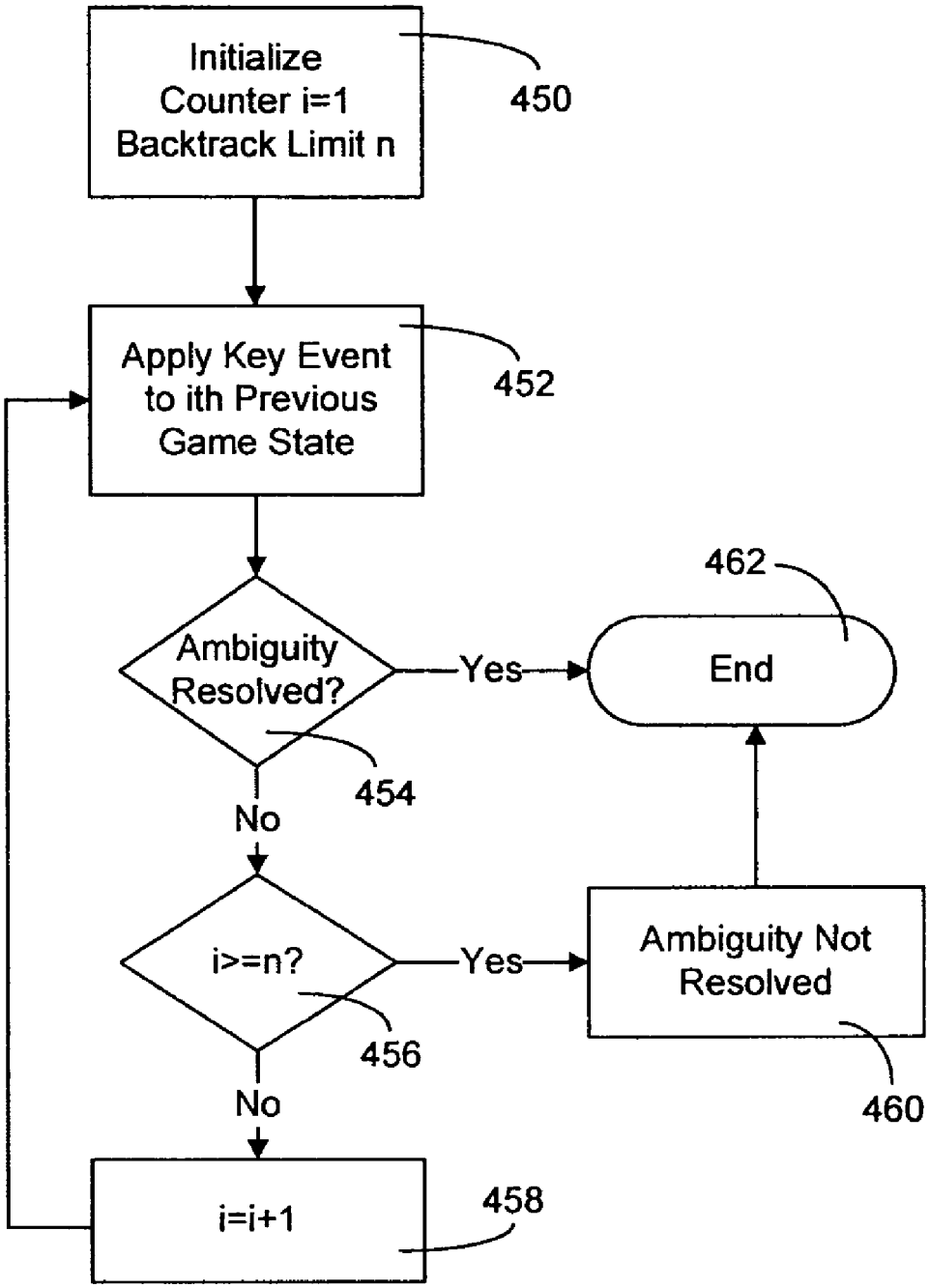
FIG. 26 is a flowchart of the process of backward tracking.

We shall now discuss how backward tracking (shown as feature 380 of FIG. 23) functions. Referring now to FIG. 26, a flowchart of the process of backward tracking is shown.

The backward tracking process starts at step 450 by initializing counter "i" to 1 and initializing "n" to the predetermined maximum number previous game states to backtrack to. In the next step 452 the ambiguous key event from the single state tracking process (step 424 of FIG. 25*b*) is compared to the $i^{th}$ previous game state to see if the key event is valid with respect to this previous game state. Moving to step 454, if the ambiguity is resolved by the comparison then backtracking has succeeded and the process ends at step 462. In step 454, if the ambiguity is not resolved then the process moves to step 456 to check if it has backtracked to the maximum limit. If the maximum limit is reached, then moving to step 460 it is determined that backtracking has not resolved the ambiguity and the process ends at step 462. If in step 456 the maximum limit has not been reached, then the process increments the counter "i" at step 458 and returns to step 452.

Backward tracking can be used to track to previous frames, in order to look for a valid key event, or to track to previous valid game states.

Figure 27:
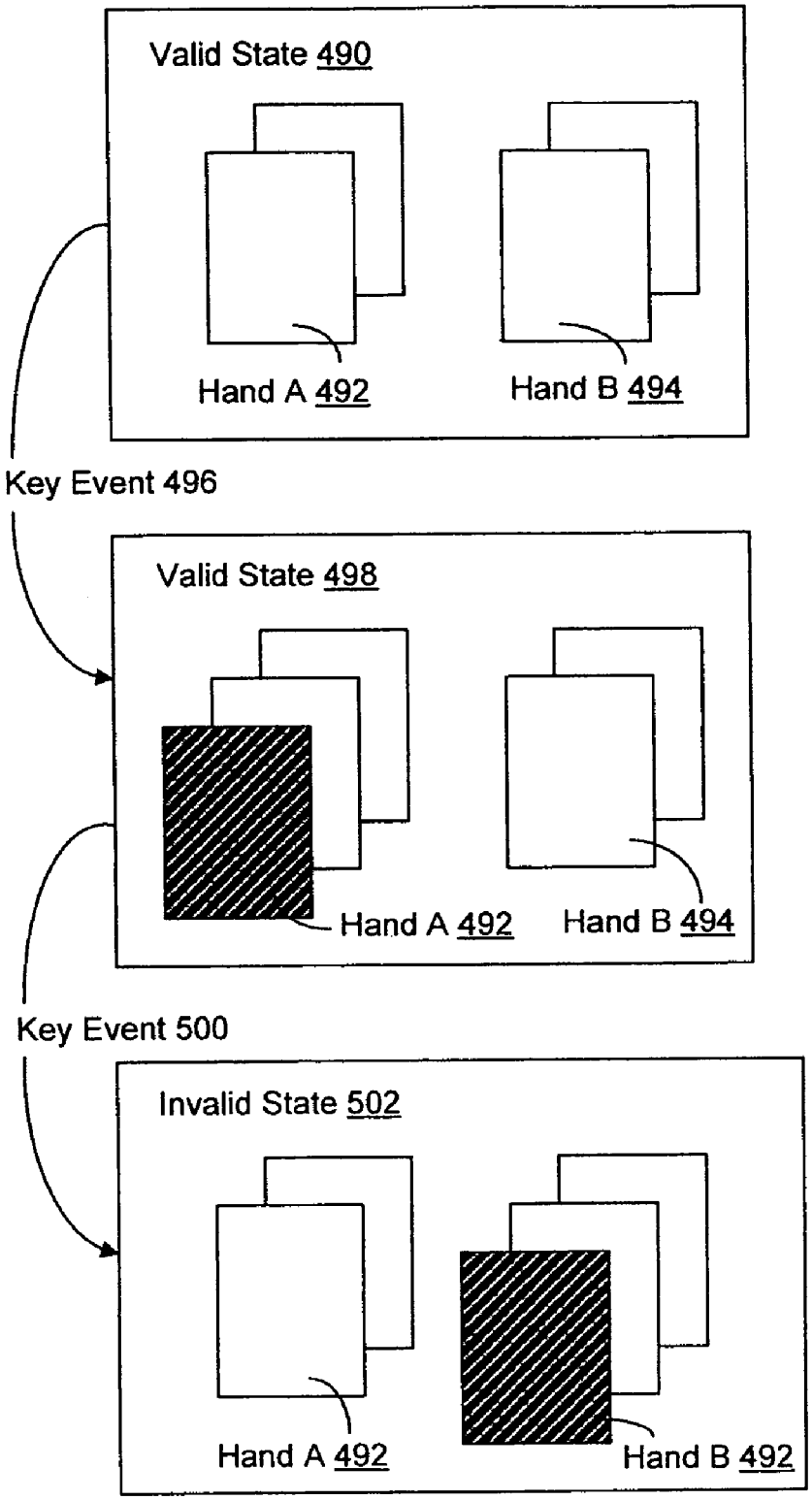
FIG. 27 is an illustrative example of backward tracking.

Referring now to FIG. 27 an illustrative example of backward tracking is shown. FIG. 27 shows how backward tracking can be used to backward track to a previous game state in order to resolve ambiguity. In this example, the IP module 80 and IPAT module 84 provide frames containing identity, location and orientation data of playing cards. In the problem scenario a valid state 490 exists with hand A 492 and hand B 494 both having two cards. At the next key event 496, the dealer accidentally dropped a card on hand A 492 so it now contains three cards and a valid game state 498 is established. At key event 500 the dealer has picked up the card and placed it on hand B 494 so that hand A 492 now contains two cards and hand B 494 now contains three cards resulting in an invalid game state 502. Key event 500 is ambiguous with respect to current game state 498 and invalid state 502 occurs because hand A 492 cannot be matched between the invalid game state 502 and the valid game state 498. The back tracking method is then activated, and the key event 500 is applied to previous valid game state 490 which results in the resolution of the ambiguity and establishing of a new valid game state (not shown) similar to invalid game state 502. The game can then continue to update with new inputs.

It is also possible that backward tracking may not be able to account for certain key events, in which case other conflict resolution methods described next can be utilized.

We shall next discuss forward tracking in more detail. Forward tracking requires a front buffer 352 of FIG. 22 to store data frames. The number of frames to store information could either be fixed or can be variable. Data frames can be analyzed after a predetermined number of frames are present in front buffer 352.

Figure 28:
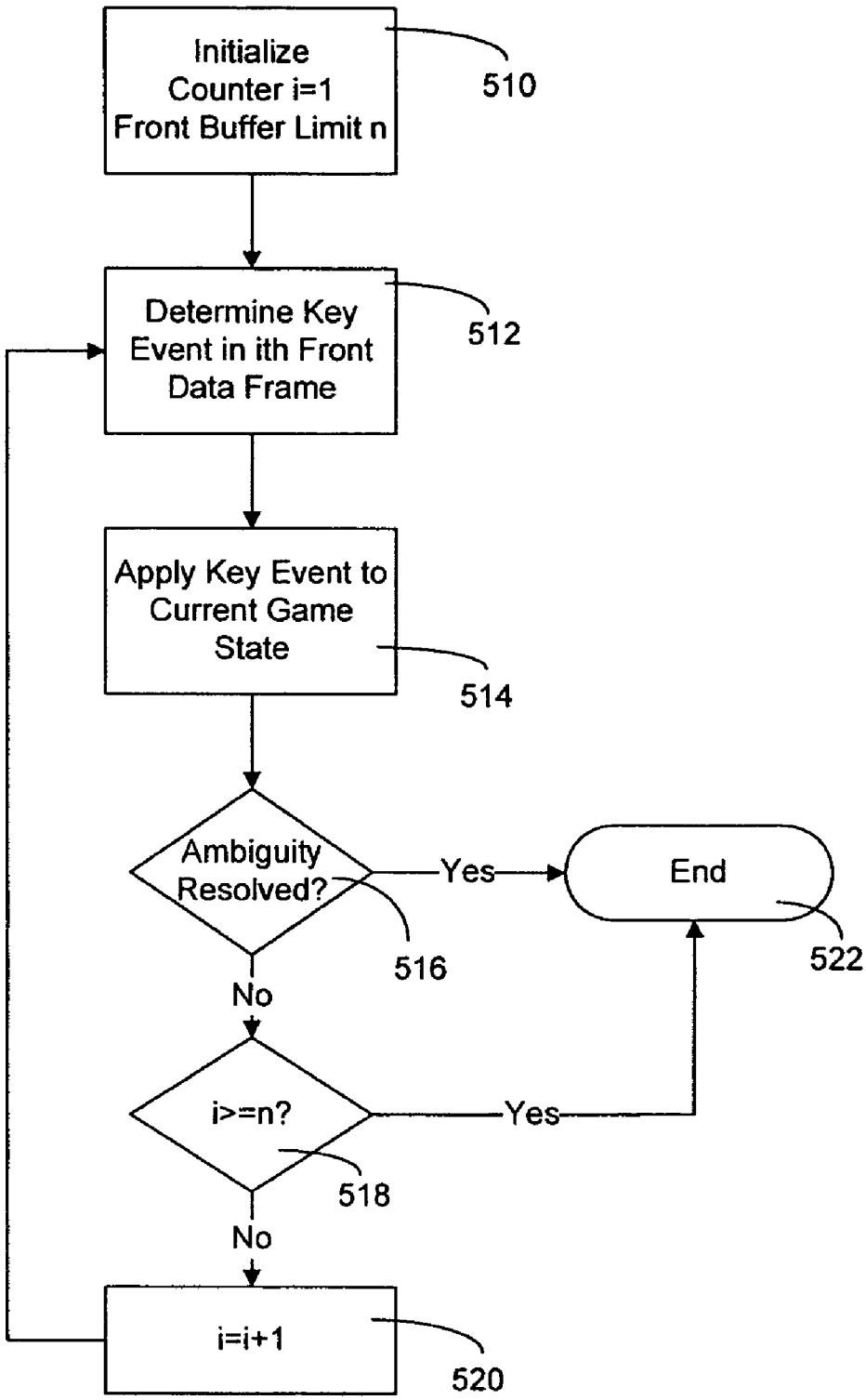
FIG. 28 is a flowchart of the process of forward tracking.

Referring now to FIG. 28 a flowchart of the process of forward tracking is shown. The forward tracking process starts at step 510 by initializing counter "i" to 1 and initializing "n" to the predetermined maximum number data frames in front buffer 352. At step 512 the $i^{th}$ data frame in the front buffer is analyzed to determine a key event (as described in previous sections). In the next step 514, the key event is compared to the current game state to determine if the key event is valid and if it resolves the ambiguity. From step 516, if the ambiguity is resolved then forward tracking has succeeded and the process ends at step 522. If the ambiguity is not resolved then moving to step 518 a determination is made on whether the end of the front buffer 352 has been reached. If the end of the front buffer has been reached then forward tracking has not been able to resolve the ambiguity and processing ends at step 522. If at step 518, the end of the front buffer 352 has not been reached, then the counter "i" is incremented in step 520, after which the process returns to step 512.

Figure 29:
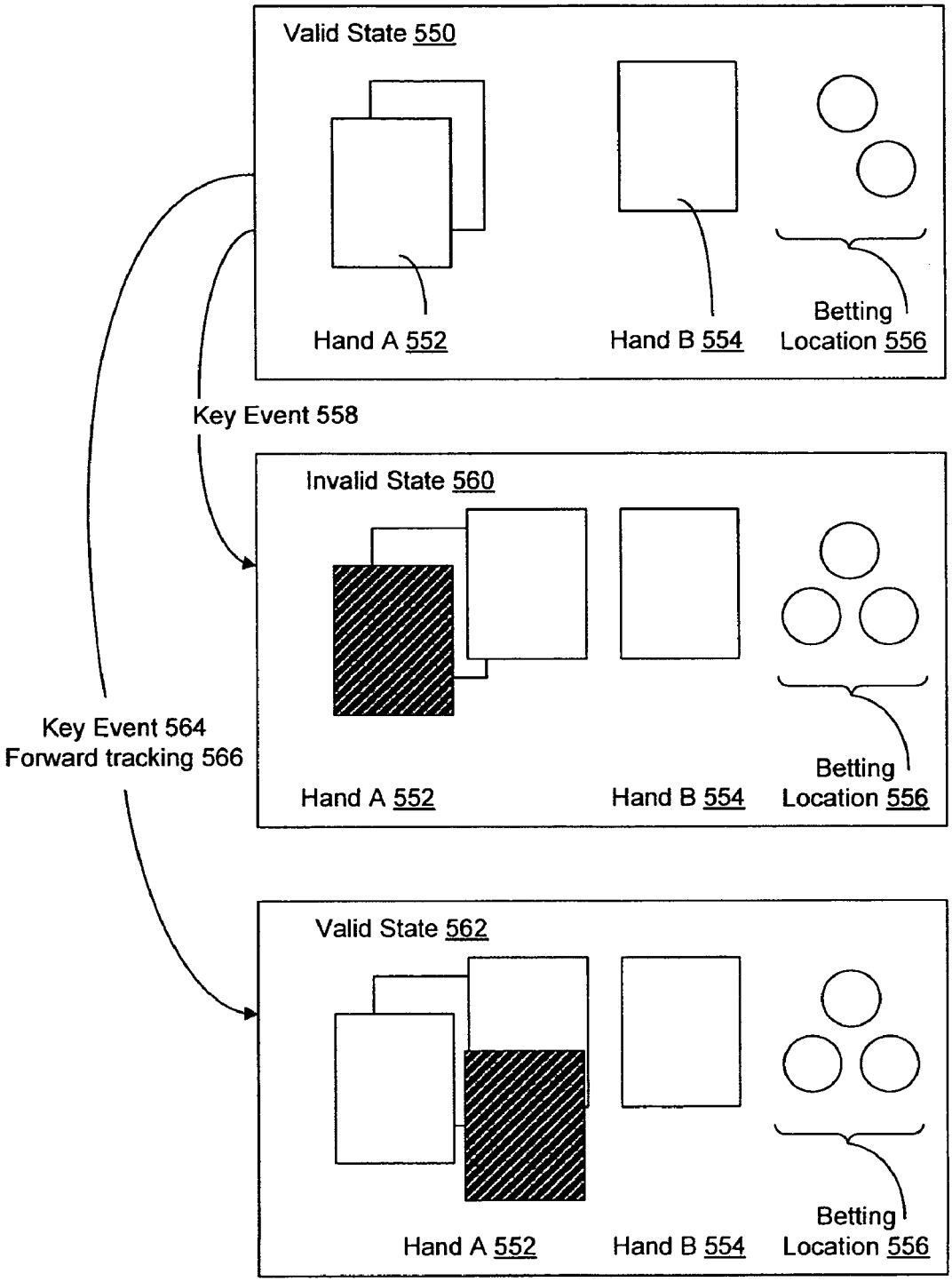
FIG. 29 is an illustrative example of forward tracking.

Referring now to FIG. 29 an illustrative example of forward tracking for the game of Blackjack is shown. In this forward tracking example, orientation information on playing cards is not available to the game tracking module 86. Valid state 550 indicates that there are two hands, hand A 552 and hand B 554, caused by one split, and there are two bets in betting location 556. Key Event 558 shows an additional third bet in betting location 556, the addition of a new card to hand A 552 and the offset top card of hand A 552 (indicating possible overlap between two hands), and the combination of the foregoing three features indicate a potential split of Hand A 552 or a double down onto Hand A 552. Key event 558 is ambiguous with respect to game state 550 since it is uncertain whether a split or a double down happened and as a result an invalid state 560 is created. From game state 550, forward tracking (shown by feature 566) into the front buffer of data frames, key event 564 shows Hand A 552 containing two overlapping card hands whereby each of the two card hands has two cards. Key event 564 is consistent with a split scenario, resolves the split/double-down ambiguity, is valid with respect to game state 550 and as a result valid game state 562 is established.

After forward tracking has been done, the data frame that produced the key event that resolved the ambiguity can be established as the current frame 358 (see FIG. 22). It is to be noted that forward tracking can involve analyzing a plurality of data frames in order to resolve ambiguity.

In the foregoing sections, the game tracking module stored the game state in a single current valid state. The current game state was updated based on events, and at the end, the state reflected the game outcome. In the case of ambiguity or conflicts, ambiguity resolution methods backtracking or forward tracking were invoked to resolve the ambiguity, and if resolved a new current game state was established. This single state model may not directly account for all possible scenarios caused by key events, such as for example, human error in the case when a card is completely withdrawn from the table and treated as a "burnt card" in Blackjack. In this scenario, the regular Blackjack game rules were not followed, and as a result, the single game state may remain in an invalid/ambiguous state until the end of the game. This is because the game state may not be able to account for the key event that a card was removed. In some scenarios an ambiguous key event may lead to two potential game states and the single state model might inadvertently pick the wrong next state since the model requires a single valid current game state at any given time.

A multiple game state model can overcome some deficiencies of the single state model by allowing flexibility in the number of current game states maintained and updated in parallel.

Figure 30:
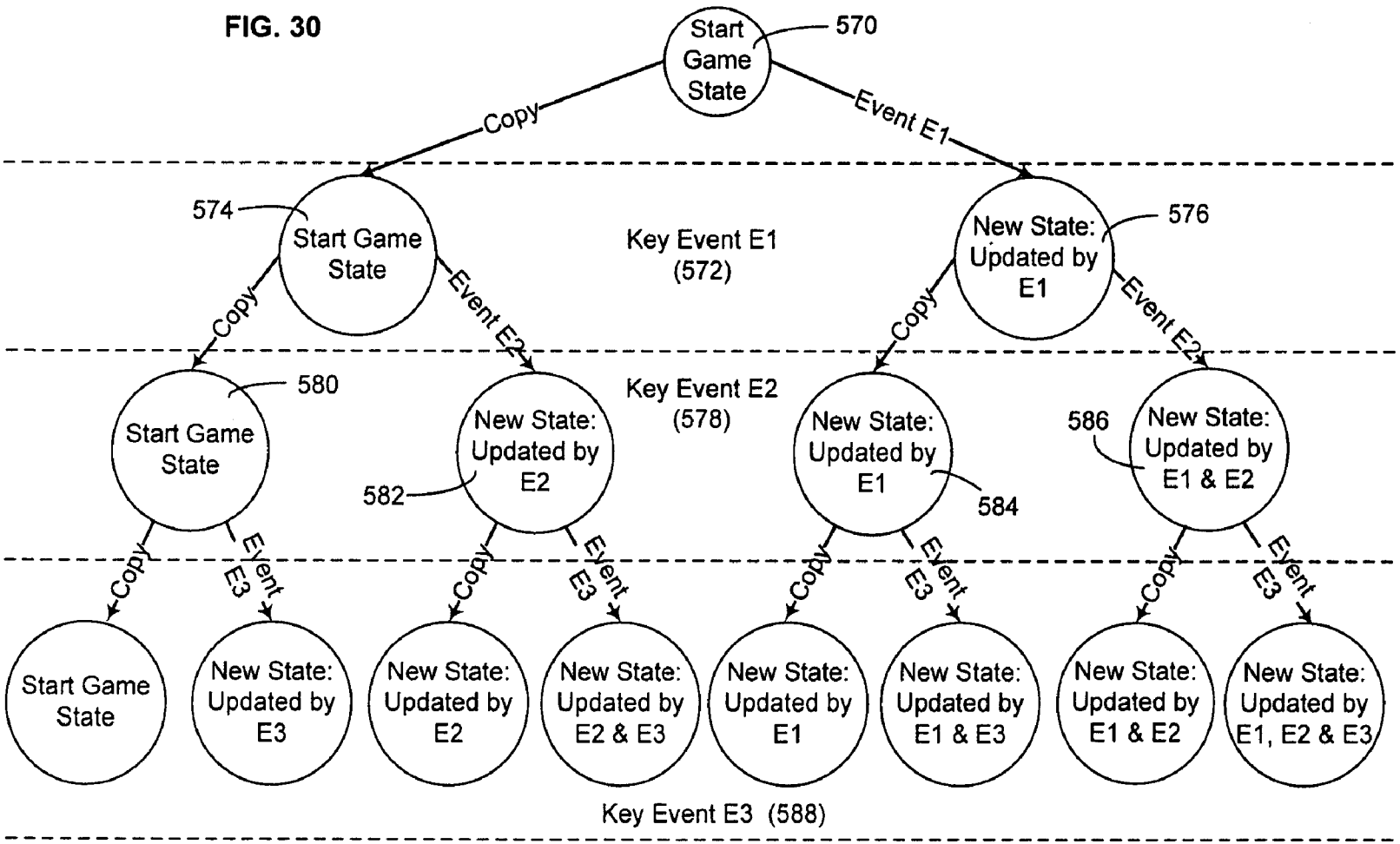
FIG. 30 is an illustrative example of multi state tracking.

Referring now to FIG. 30 an illustrative example of multi state tracking is shown. All variables are initialized at the start of the game at the start game state. The term node is herein referred to as an instance of the game state. On the occurrence of every key event, the node to the left is always copied with the current state and the node to the right is always updated with the new key event. At key event E1 (feature 572), the start game state 570 is copied to the left as node 574 and updated to the right with key event E1 as shown by node 576. This process continues at key event E2 (feature 578) to create nodes 580, 582, 584 and 586. At the end of this update, the previous game state can be destroyed. This process continues for each key event until the end state is reached.

The representation is very similar to a binary tree with a rule that every child node to the left is a copy of the current node and every child node to the right is updated with the key event. An advantage of this representation is that all possible valid combinations of sequential key events are automatically utilized to update the game states.

The multiple game state game tracking model can handle backtracking since the previous game state can be copied over as a node for comparison with the new input. Although FIG. 30 illustrates a tree structure, the actual implementation in software may take different forms including a linked list of game states or an array of game states. The tree structure is utilized to explain the concept of multiple state game tracking in a visual format.

Storing all the possible game states may decrease performance of the multi game state model. An optimization to the multiple state game tracking method could be the use of two variables, one that stores how many key events have passed, and the other that stores when and which key event caused the most recent valid status update in the game state. All the nodes that have not caused a valid status update in the past fixed number of key events can be nullified.

Figure 31A:
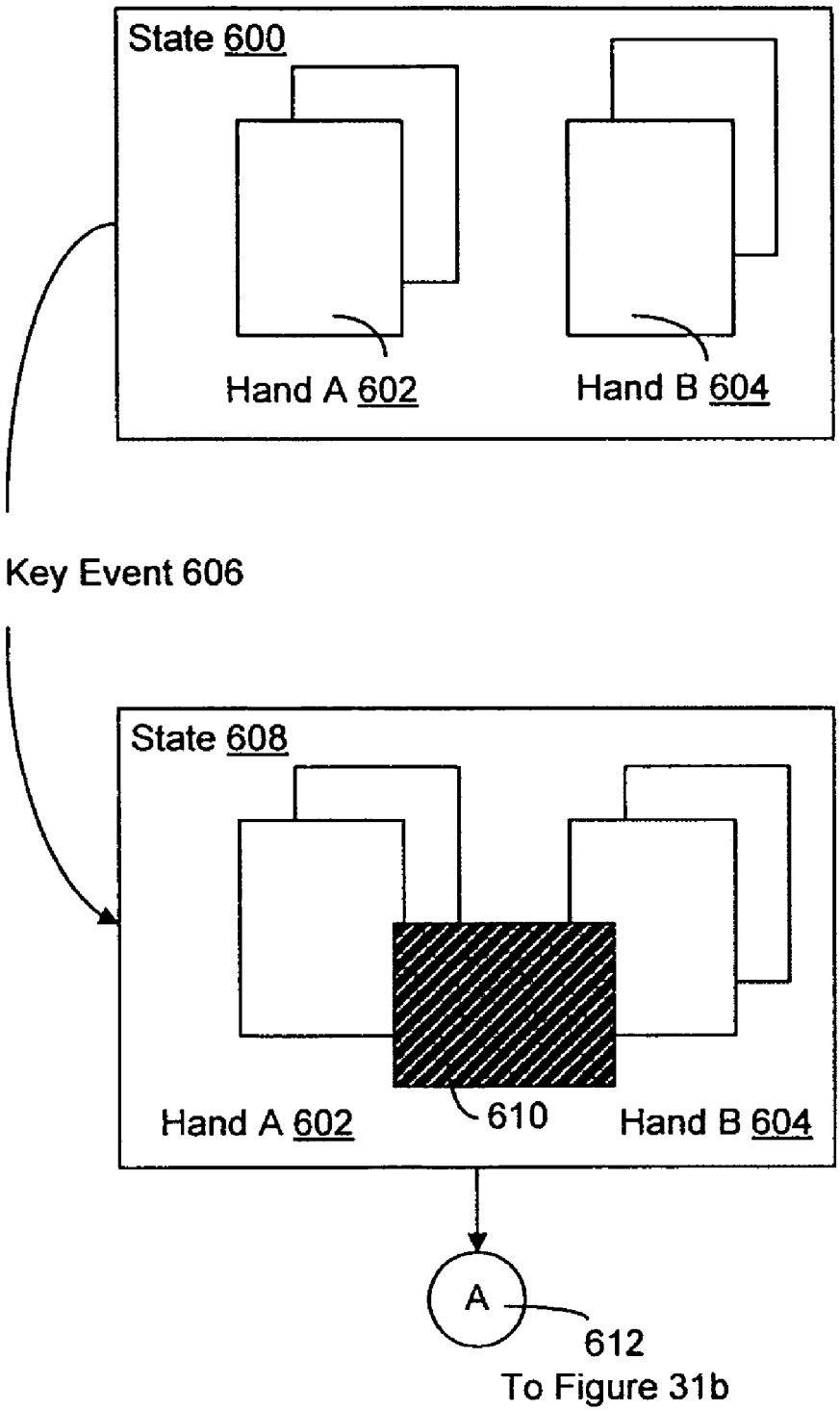
FIGS. 31*a* and 31*b* are illustrative examples of multiple game states.
Figure 31B:
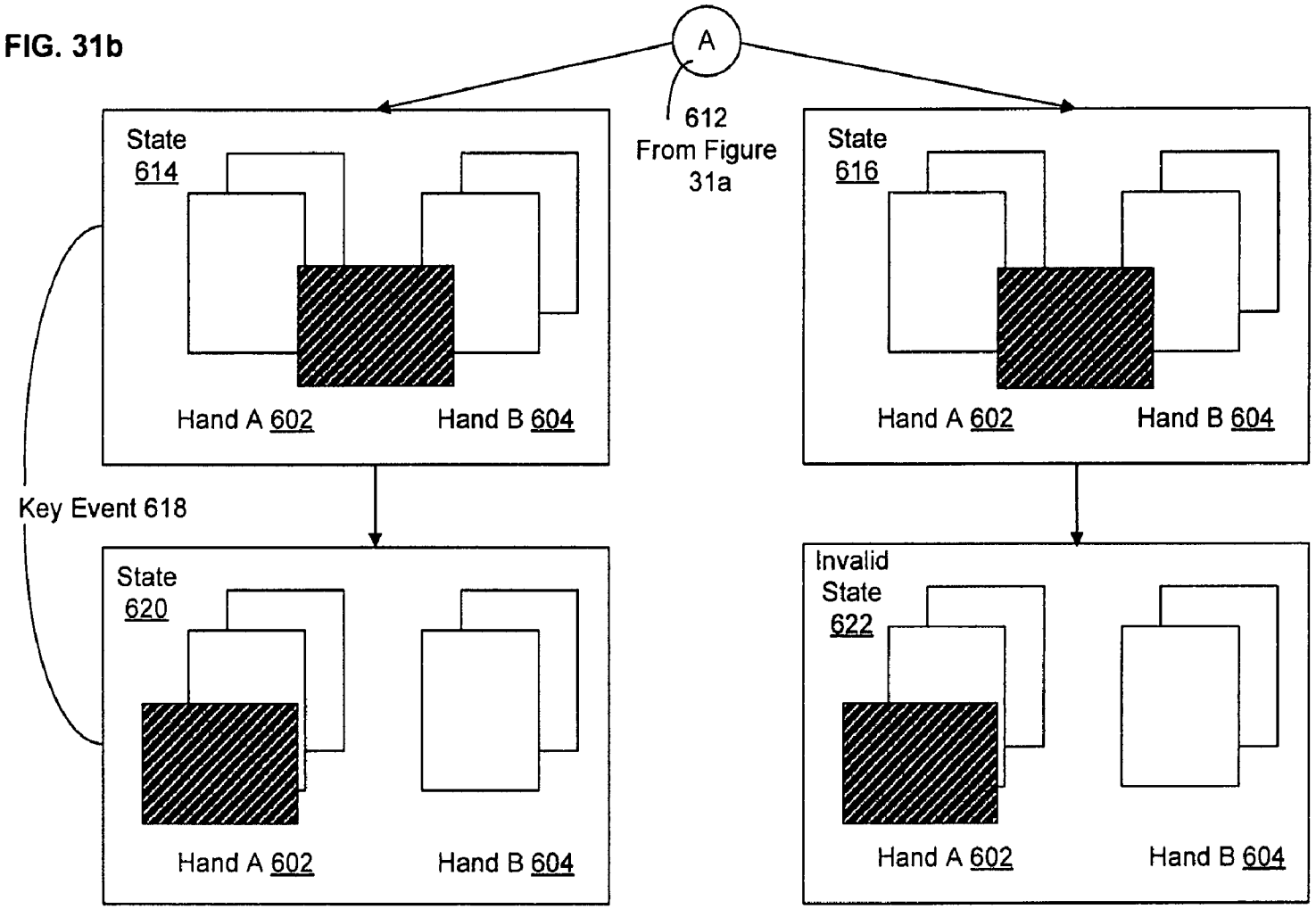

The multiple game state model, can be extended to create new states every time there is ambiguity during the update of a game state. As an example, if there is an ambiguous situation where two game states are possible, the game tracking module can create two new states, and update both the states based on future key events. This is shown by FIGS. 31*a* and 31*b*, which are illustrative examples of multiple valid game states. Referring first to FIG. 31*a*, state 600 shows two card hands 602 and 604 each having two cards. Key event 606 occurs when the dealer adds a new card 610 oriented horizontally, as usually done for a double down, overlapping both card hands 602 and 604. Key event 604 is ambiguous in that it is not clear if the double down card 610 was added to hand 602 or hand 604. Because of this ambiguity, two new game states 614 and 616 are created. Game state 614 represents the new double down card 610 added to hand 602 to give it three cards, while state 616 represents the new double down card 610 added to hand 604 to give it three cards. Key event 618 happens at a later time when the dealer moves the new card 610 over to the left to cover hand 602 which clarifies the configuration of state 620. The new state 620 resolves the ambiguity of which hand the double down card was dealt to. Game state 620 finds a complete match between its current game state and the new input from key event 618. However game state 622 will not find a match with the new input as hand 604 does not have three cards, therefore game state 622 is invalid and may not proceed forward.

The game state that gets updated with a valid Status consistently with new key events will likely prevail ultimately and will likely accurately reflect the actual game outcome. The multiple state model may lead to more than one valid end game state. In this scenario, an evaluation of the end game states needs to be made as to which end game state is the correct one. In order to assist with this evaluation, a game state may be provided with a likelihood score. The likelihood score of a game state represents the likelihood that the game state is accurate. The likelihood score can also be utilized in the middle of the game to determine the most likely game state from the list of multiple states that may be maintained and updated. Examples of parameters that may be included in a likelihood score are:

a) How many key events have passed for the specific game state; the higher the number of key events the larger the likelihood score.

b) The time stamp of the most recent key event for the specific game state; the more recent the time stamp the larger the likelihood score.

c) The total number of cards and card hands that were matched for this game state; the higher the number of matches the larger the likelihood score.

d) The total number of cards and card hands that were not matched for this game state; the lower the number of unmatched cards/card hands the larger the likelihood score.

e) The number of cards in a game state; the larger the number of cards the higher the likelihood score.

f) Addition or removal of chips and the chip values at betting spots (if the data is available); the closer the chip movements and values match game rules the larger the likelihood score.

A historical record of a plurality of the foregoing parameters can be stored for each game state (the historical record would be the scores of its parent and ancestor nodes or scores for previous data frames that were compared to the game state); the historical record can be traversed and combined with the current likelihood score to determine an aggregate likelihood score.

The likelihood scores may be used or combined into a formula to provide a single likelihood score. The formula may provide different priority levels for the different scoring parameters. The formula may combine scoring parameters over a period of time, such as the past two seconds, or over a number of data frames, such as the past forty data frames, to determine a current likelihood score. In the event that more than one valid end game state exists, the likelihood score(s) of each state may be compared to determine which end game state is the correct game state.

In an alternate embodiment, multiple game state game tracking may be integrated with a card shoe based reader. In this embodiment, the dispensing of a new identified card may be classified as a key event, which may trigger the creation of new game states where each new game state represents a different card hand receiving the new card. The likelihood score concepts and other concepts explained in this section may be integrated with this embodiment to assist with determining the most likely correct game state.

Returning to FIG. 6 we will now discuss bet recognition module 88. Bet recognition module 88 can determine the value of wagers placed by players at the gaming table. In one embodiment, an RFID based bet recognition system can be implemented, as shown in FIG. 5. Different embodiments of RFID based bet recognition can be used in conjunction with gaming chips containing RFID transmitters. As an example, the RFID bet recognition system sold by Progressive Gaming International or by Chipco International can be utilized.

In another embodiment, a vision based bet recognition system can be employed in conjunction with the other modules of this system. There are numerous vision based bet recognition embodiments, such as those described in U.S. Pat. Nos. 5,782,647 to Fishbine et al.; 5,103,081 to Fisher et al; 5,548,110 to Storch et al.; and 4,814,589 to Storch et al. Commercially available implementations of vision based bet recognition, such as the MP21 system marketed by Bally Gaming or the BRAVO system marketed by Genesis Gaming, may be utilized with the invention.

The bet recognition module 88 can interact with the other modules to provide more comprehensive game tracking. As an example, the game tracking module 86 can send a capture trigger to the bet recognition module 88 at the start of a game to automatically capture bets at a table game.

Referring to FIG. 6 we will now discuss player tracking module 90. Player tracking module 90 can obtain input from the IP module 80 relating to player identity cards. The player tracking module 90 can also obtain input from the game tracking module 86 relating to game events such as the beginning and end of each game. By associating each recognized player identity card with the wager located closest to the card in an overhead image of the gaming region, the wager can be associated with that player identity card. In this manner, comp points can be automatically accumulated to specific player identity cards.

Optionally the system can recognize special player identity cards with machine readable indicia printed or affixed to them (via stickers for example). The machine readable indicia can include matrix codes, barcodes or other identification indicia.

Optionally, biometrics technologies such as face recognition can be utilized to assist with identification of players.

Figure 32:
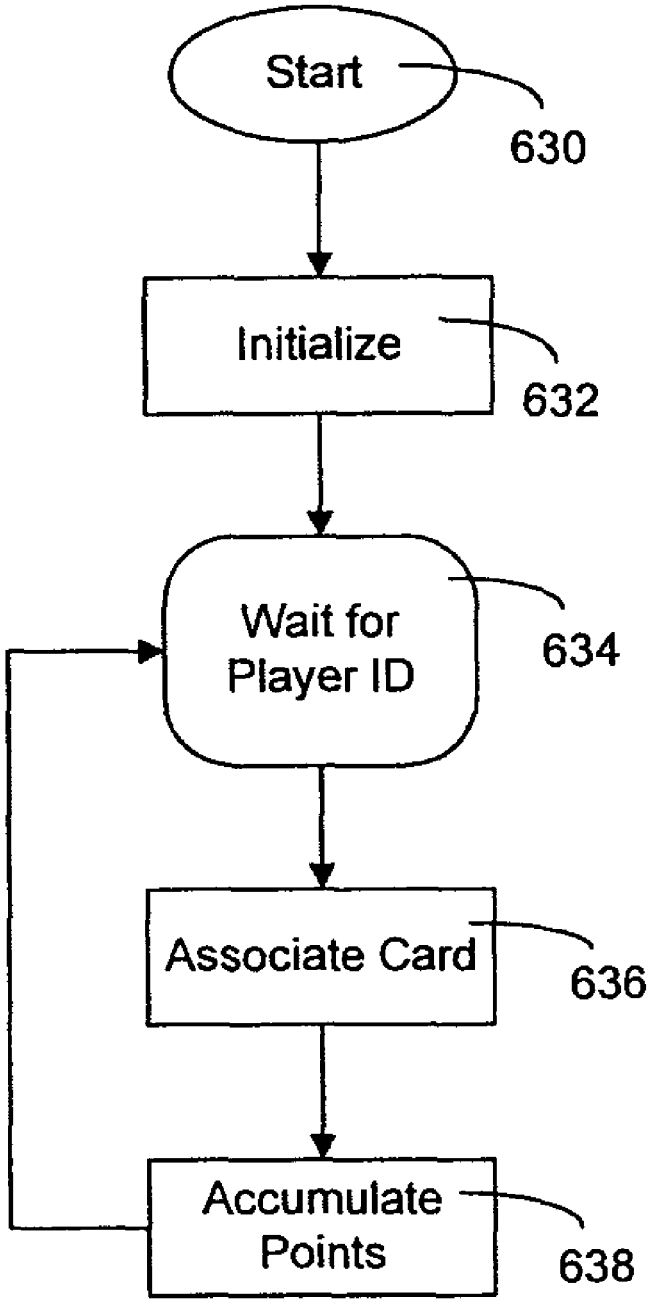
FIG. 32 is a flowchart of the process of player tracking.

Referring now to FIG. 32 a flowchart of the process of player tracking is shown. The process invoked by player tracking module 90 starts at step 630 and moves to step 632 where the appropriate imaging devices are calibrated and global variables are initialized. At step 634 processing waits to obtain positioning and identity of a player identity card from IP module 80. At step 636 an association is made between a player identity card and the closest active betting region. At step 638 complementary points are added to the player identity card based upon betting and game activity. Once a game ends processing returns to step 634.

We will now discuss the functionality of surveillance module 92. Surveillance module 92 obtains input relating to automatically detected game events from one or more of the other modules and associates the game events to specific points in recorded video. The surveillance module 92 can include means for recording images or video of a gaming table. The recording means can include the imagers 32. The recording means can be computer or software activated and can be stored in a digital medium such as a computer hard drive. Less preferred recording means such as analog cameras or analog media such as video cassettes may also be utilized.

Figure 33:
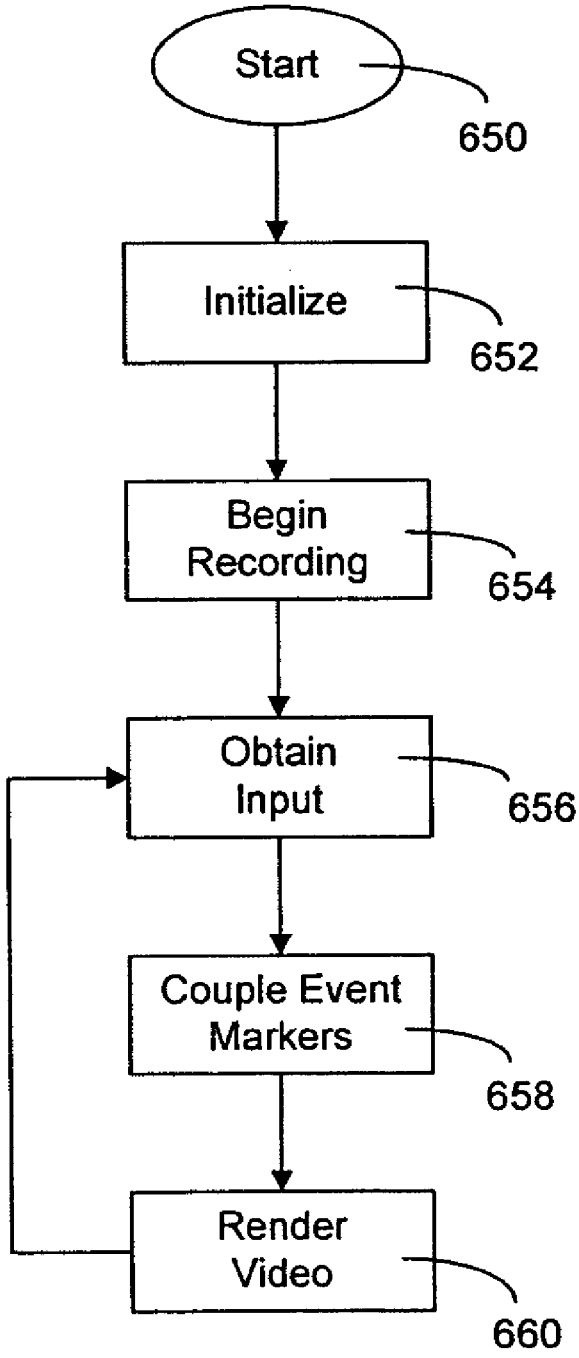
FIG. 33 is a flowchart of the process of surveillance.

Referring now to FIG. 33 a flowchart of the process of surveillance is shown. Beginning at step 650 the process starts and at step 652 the devices used by the surveillance module are calibrated and global variables are initialized. Moving to step 654 recording begins. At step 656 input is obtained from other modules. The surveillance module 92 can receive automatically detected game events input from one or more of the other modules. As an example, the surveillance module 92 can receive an indicator from the game tracking module 86 that a game has just begun or has just ended. As another example, the surveillance module 92 can receive input from the bet recognition module 88 that chips have been tampered with. In yet another example, the surveillance module 92 can receive input from the player tracking module 90 that a specific player is playing a game. At step 658 a game event or player data related event is coupled to an event marker on the video. The surveillance module 92 associates the game events to specific points in recorded video using digital markers. Various embodiments of markers and associations are possible. As a non-limiting example, the surveillance module can keep an index file of game events and the associated time at which they took place and the associated video file that contains the recorded video of that game event. Associating automatically tracked table game events/data to recorded video by using event markers or other markers can provide efficient data organization and retrieval features. In order to assist surveillance operators, data may be rendered onto the digital video. For instance, a color coded small box may be rendered beside each betting spot on the video. The color of the box may be utilized to indicate the current game status for the player. As an example, the color red may be used to indicate that the player has bust and the color green may be used to indicate that the player has won. Various symbols, text, numbers or markings may be rendered onto the surveillance video to indicate game events, alerts or provide data. An advantage of this feature is that it enables surveillance operators to view data faster. For example, it is easier for a surveillance operator to see a green colored box beside a betting spot and understand that the player has won, than to total up the player's cards and the dealer's cards to determine who won. In this feature, game data may be rendered directly onto the video during recording, or the data may be stored in a database and then dynamically rendered onto the video during playback only. Furthermore, additional features such as by example, notes and incident reports can be incorporated into the surveillance module. Additionally, sound recording may be incorporated into the surveillance module in order to capture the sounds happening at the gaming table. For example, sound capturing devices (for example: microphones) may be positioned in the overhead imaging system or lateral imaging system or at any other location in the vicinity of the gaming region. The captured sound may be included into the recorded video. Optionally, speech recognition software or algorithms may be used to interpret the sounds captured at the gaming table. At step 660 the event data is recorded on video. Processing then returns to step 656.

Figure 34:
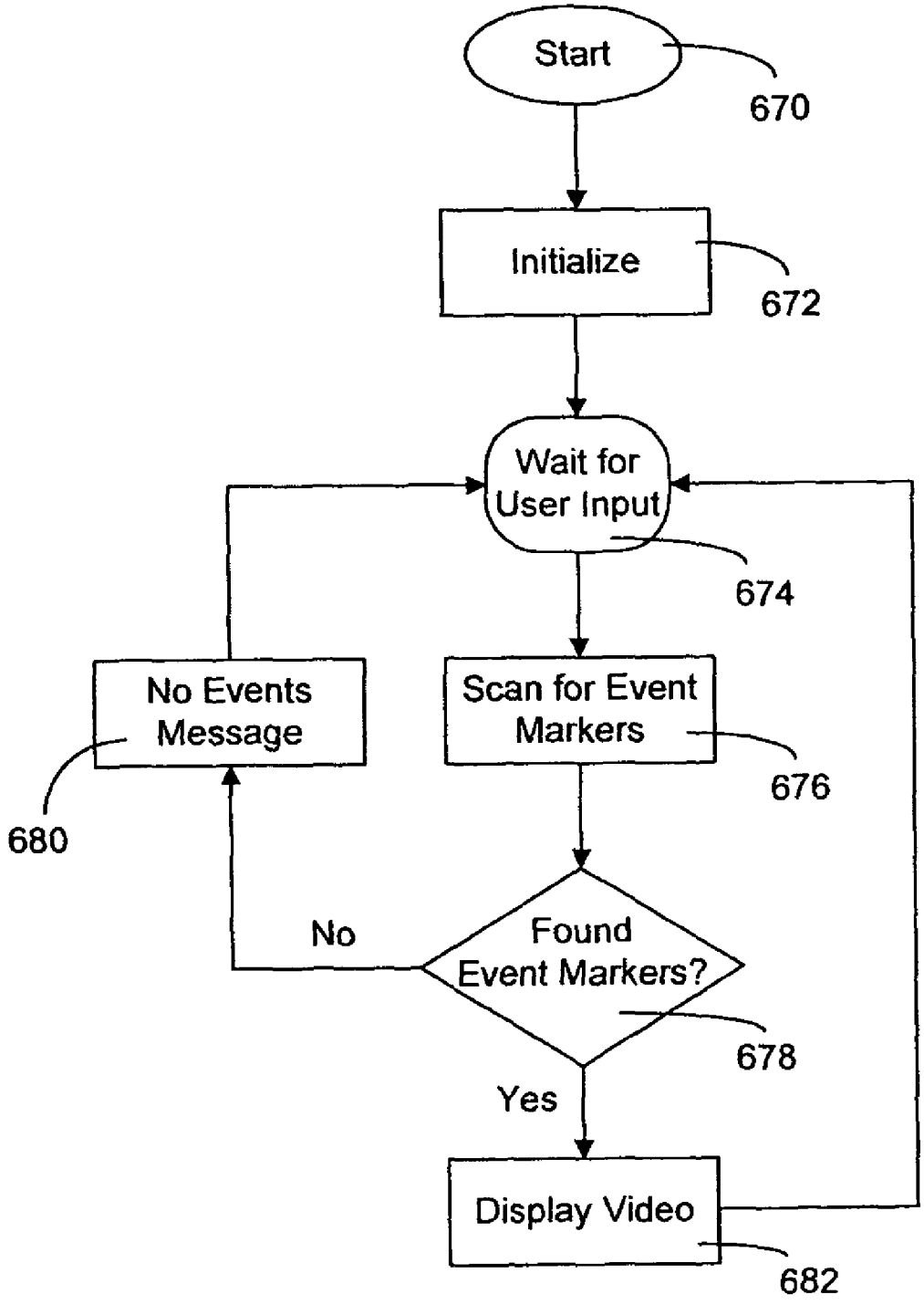
FIG. 34 is a flowchart of the process of utilizing surveillance data.

The surveillance module 92 can replay certain video sequences relating to gaming events based on a selection of a game event. FIG. 34 is a flowchart of the process of utilizing surveillance data. FIG. 34 illustrates how a user interface may be coupled with the data collected by surveillance module 92 to display data of interest to a user. Processing begins at step 670 and a step 672 calibration of the necessary hardware and the initialization of data variables occurs. At step 674 the process waits for input from the user on what video is requested. The user can select a specific gaming table and view recorded video clips organized by game. Alternatively, the user can select a specific player and view video clips organized by player. Similarly, the user can potentially select certain game events such as tampering of chips and view the clips associated with those game events. At step 676 a search is made for the event markers that are relevant to the user input of step 674 and are located on the recorded media. At step 678 a test is made to determine if any event markers were found. If not processing moves to step 680 where a message indicating no events were located is displayed to the user. Processing then returns to step 674. If event markers have been found at step 678 then processing moves to 682 and the relevant images are displayed to the user. Control then returns to step 674 where the user may view the video. During display the user may utilize the standard features of video and sound imaging, for example: speed up, slow down, freeze frame, and increase resolution.

We shall now discuss the analysis and reporting module 94 of FIG. 6. Analysis and reporting module 94 can mine data in the database 102 to provide reports to casino employees. The module can be configured to perform functions including automated player tracking, including exact handle, duration of play, decisions per hour, player skill level, player proficiency and true house advantage. The module 94 can be configured to automatically track operational efficiency measures such as hands dealt per hour reports, procedure violations, employee efficiency ranks, actual handle for each table and actual house advantage for each table. The module 94 can be configured to provide card counter alerts by examining player playing patterns. It can be configured to automatically detect fraudulent or undesired activities such as shuffle tracking, inconsistent deck penetration by dealers and procedure violations. The module 94 can be configured to provide any combination or type of statistical data by performing data mining on the recorded data in the database.

Output, including alerts and player compensation notifications, can be through output devices such as monitors, LCD displays, or PDAs. An output device can be of any type and is not limited to visual displays and can include auditory or other sensory means. The software can potentially be configured to generate any type of report with respect to casino operations.

Module 94 can be configured to accept input from a user interface running on input devices. These inputs can include, without limitation, training parameters, configuration commands, dealer identity, table status, and other inputs required to operate the system.

Although not shown in FIG. 6 a chip tray recognition module may be provided to determine the contents of the dealer's chip bank. In one embodiment an RFID based chip tray recognition system can be implemented. In another embodiment, a vision based chip tray recognition system can be implemented. The chip tray recognition module can send data relating to the value of chips in the dealer's chip tray to other modules.

Although not shown in FIG. 6, a deck checking module may be provided. A deck checking module would receive card identity and location data from the IP module 80. The card identity and location data can be utilized to perform automated verification of deck checking as a dealer performs manual deck checking.

Although not shown in FIG. 6, a dealer identity module may be employed to track the identity of a dealer. The dealer can optionally either key in her unique identity code at the game table or optionally she can use an identity card and associated reader to register their identity. A biometrics system may be used to facilitate dealer or employee identification.

All of or parts of the disclosed invention as disclosed can be utilized to enable new game development such as fixed jackpot games, progressive jackpot games, bonusing games, manual and electronic side betting games. Partially automated Blackjack based and Baccarat based games can be developed similar to the popular game Rapid Roulette. As an example, a player can make an electronic side bet at a table where the win or loss of the side bet would be dependent on whether a specific game outcome (such as achieving a player hand total of 21) or specific game event (such as receiving a pair in the initial deal of two cards) occurs. The disclosed system can automatically detect game events and the outcome of a game and consequently establish whether the player's side bet lost or won. Upon determination of the win or loss of the side bet, Analysis and Reporting module 94 can send a signal on the side bet win/loss to outside systems or modules. As an example, the disclosed invention may be utilized in conjunction with the table game electronic auxiliary bet systems offered by DEQ Systems Corp. to automatically determine game outcome, and payouts/debits for player side bets. As another example, the disclosed invention may be utilized in conjunction with the Progressive Jackpot games (such as Progressive Blackjack) offered by Progressive Gaming International Corp. to automatically determine game outcome, and consequently determine payouts/debits for player wagers. As yet another example, the disclosed invention can be utilized in conjunction with IGT's State-Of-The-Art Bonusing Concepts such as Automated Payout Multiplier for table games to trigger multiple payouts to a player based on the game wins/losses of the player as tracked by the disclosed invention.

The terms imagers and imaging devices have been used interchangeably in this document. The imagers can have any combination of sensor, lens and/or interface. Possible interfaces include, without limitation, 10/100 Ethernet, Gigabit Ethernet, USB, USB 2, FireWire, Optical Fiber, PAL or NTSC interfaces. For analog interfaces such as NTSC and PAL a processor having a capture card in combination with a frame grabber can be utilized to get digital images or digital video.

The image processing and computer vision algorithms in the software can utilize any type or combination or color spaces or digital file formats. Possible color spaces include, without limitation, RGB, HSL, CMYK, Grayscale and binary color spaces.

The overhead imaging system may be associated with one or more display signs. Display sign(s) can be non-electronic, electronic or digital. A display sign can be an electronic display displaying game related events happening at the table in real time. A display and the housing unit for the overhead imaging devices may be integrated into a large unit. The overhead imaging system may be located on or near the ceiling above the gaming region.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

We claim:

1. A method of tracking the progress of a game on a gaming table using game table tracking equipment comprising:

recording data frames using game table tracking equipment while said game is in progress, said data frames representing gaming table objects used in play of said game for each game event in the progress of the game;

establishing a state of said game from machine processing of said data frames and a set of rules of said game to determine said state for each of said data frames;

wherein said state is determined using a corresponding one of said data frames when said corresponding one of said data frames and said set of rules provide sufficient information to accurately define said state; and wherein said state is determined using one or more of said data frames later than said state and a corresponding one of said data frames when said corresponding one of said data frames and said set of rules provide insufficient information to accurately define said state.

2. The method of claim 1 wherein said state is established when said game event in said data frame is coherent with respect to a previous one of said states and said set of rules.

3. The method of claim 1 wherein said recording data frames comprises recording overhead images of said gaming table while said game is in progress.

4. The method of claim 1 wherein said recording data frames comprises recording data collected from RFID sensors within said gaming table.

5. The method of claim 1 wherein said recording data frames comprises recording data collected from proximity detection sensors within said gaming table.

6. The method of claim 1 wherein a first one of said states is defined by a plurality of parameters related to a plurality of playing cards positioned on said gaming table.

7. The method of claim 1 wherein said method is embodied in computer instructions in a computer readable medium.

8. A system of for tracking the progress of a game on a gaming table comprising:

a processor for recording data frames and game states as data while said game is in progress, said data frames representing gaming table objects used in play of said game for each game event in the progress of the game;

a processor for establishing states of said game for each of said data frames by processing said data frames in accordance with rules of said game;

wherein said state is determined using a corresponding one of said data frames when said corresponding one of said data frames and said set of rules provide sufficient information to accurately define said state; and wherein said state is determined using one or more of said data frames later than said state and a corresponding one of said data frames when said corresponding one of said data frames and said set of rules provide insufficient information to accurately define said state.

9. The system of claim 8 wherein said processor for establishing determines whether said game event is or is not coherent with respect to said state and said set of rules.

10. The system of claim 8 further comprising:

a processor for storing a back buffer of previous data frames;

a processor for storing a front buffer of future data frames;

a processor for utilizing either or both of said back buffer and said front buffer to create said second state from said first state based upon a current data frame.

* * * * *